US012800174B2

(12) United States Patent
Watanabe

(10) Patent No.: US 12,800,174 B2
(45) Date of Patent: Nov. 17, 2026

(54) AIR-CONDITIONING OPERATION TERMINAL, COMPUTER READABLE MEDIUM AND AIR-CONDITIONING SYSTEM

(71) Applicant: MITSUBISHI ELECTRIC CORPORATION, Tokyo (JP)

(72) Inventor: Futa Watanabe, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 361 days.

(21) Appl. No.: 18/421,445

(22) Filed: Jan. 24, 2024

(65) Prior Publication Data

US 2024/0159418 A1 May 16, 2024

Related U.S. Application Data

(63) Continuation of application No. PCT/JP2021/033898, filed on Sep. 15, 2021.

(51) Int. Cl.
*F24F 11/65* (2018.01)
*F24F 11/56* (2018.01)

(52) U.S. Cl.
CPC ..... *F24F 11/65* (2018.01); *F24F 11/56* (2018.01)

(58) Field of Classification Search
CPC ..... F24F 11/65; F24F 11/56
USPC ..... 700/276
See application file for complete search history.

(56) References Cited

U.S. PATENT DOCUMENTS

2012/0214399 A1 8/2012 Tsuji
2012/0220212 A1 8/2012 Tsuji
2015/0061841 A1* 3/2015 Lee ..... G08C 23/04 340/12.5
2017/0307246 A1* 10/2017 Ohara ..... F24F 11/58
2020/0363779 A1 11/2020 Katsukura et al.
2021/0190361 A1* 6/2021 Chae ..... G06N 3/045
2021/0190363 A1* 6/2021 Otsuki ..... F24F 11/63
(Continued)

FOREIGN PATENT DOCUMENTS

EP 2 982 911 A1 2/2016
JP 2009-79786 A 4/2009
JP 2010-261643 A 11/2010
(Continued)

OTHER PUBLICATIONS

International Search Report (PCT/ISA/210) issued in PCT/JP2021/033898 mailed on Nov. 30; 2021.
(Continued)

*Primary Examiner* — Jigneshkumar C Patel
(74) *Attorney, Agent, or Firm* — Birch, Stewart, Kolasch & Birch, LLP

(57) ABSTRACT

An object detection unit (212) uses a learned model to detect a plurality of vanes in a captured image in which an air-conditioning indoor unit is captured. A vane selection unit (214) selects a target vane from the plurality of vanes in the captured image. An image display unit (215) displays a superimposed image in which a target identification mark and an adjustment interface are superimposed. A designation acceptance unit (216) accepts adjustment details designated by operating the adjustment interface. An air-conditioning setting unit (217) sets the accepted adjustment details in the air-conditioning indoor unit.

10 Claims, 26 Drawing Sheets

(56) References Cited

U.S. PATENT DOCUMENTS

2023/0040665 A1 2/2023 Saito et al.

FOREIGN PATENT DOCUMENTS

| | | | | |
|---|---|---|---|---|
| JP | 2011-94924 | A | 5/2011 | |
| JP | 2011-94934 | A | 5/2011 | |
| JP | 2012-83077 | A | 4/2012 | |
| JP | 2012-154593 | A | 8/2012 | |
| JP | 2013-113489 | A | 6/2013 | |
| JP | 2014-190686 | A | 10/2014 | |
| JP | 2014-202366 | A | 10/2014 | |
| JP | 2016-137836 | A | 7/2015 | |
| JP | 2016-210062 | A | 11/2015 | |
| JP | 2016-224858 | A | 12/2015 | |
| JP | 2016-142446 | A | 8/2016 | |
| JP | 2016-166695 | A | 9/2016 | |
| JP | 2017-13379 | A | 1/2017 | |
| JP | 2017-145983 | A | 8/2017 | |
| JP | 6946763 | B1 | 10/2021 | |
| WO | WO 2009/041320 | A1 | 4/2009 | |
| WO | WO 2010/126804 | A1 | 11/2010 | |
| WO | WO 2014/080465 | A1 | 5/2014 | |
| WO | WO-2014162975 | A1 * | 10/2014 | ..... F24F 11/30 |
| WO | WO 2019/087378 | A1 | 5/2019 | |
| WO | WO 2021/240625 | A1 | 12/2021 | |

OTHER PUBLICATIONS

German Office Action issued in German Application No. 11 2021 007 949.2 on Nov. 14, 2024, with English translation.

* cited by examiner

Fig. 6

292: VANE IDENTIFICATION DATA

| POSITION NUMBER | IDENTIFICATION NUMBER |
|---|---|
| 1 | 2 |
| 2 | 3 |
| 3 | 4 |
| 4 | 1 |

AIR-CONDITIONING OPERATION TERMINAL, COMPUTER READABLE MEDIUM AND AIR-CONDITIONING SYSTEM

CROSS REFERENCE TO RELATED APPLICATION

This application is a Continuation of PCT International Application No. PCT/JP2021/033898, filed on Sep. 15, 2021, which is hereby expressly incorporated by reference into the present application.

TECHNICAL FIELD

The present disclosure relates to operations of an air-conditioning apparatus.

BACKGROUND ART

There are air-conditioning apparatuses whose indoor units have a plurality of vanes. For example, many ceiling-mounted indoor units have a plurality of vanes.

In using such an air-conditioning apparatus, a more comfortable indoor environment can be achieved by adjusting an air direction, an air volume, and so on for each vane.

Patent Literature 1 discloses a technology for performing operations for changing an air direction and an air volume using a terminal device such as a smartphone.

In this technology, a virtual space image corresponding to air blown from a vane of an indoor unit is displayed on a screen. Then, a user performs operations for changing the air direction and the air volume by touching the screen.

CITATION LIST

Patent Literature

Patent Literature 1: JP 2014-190686 A

SUMMARY OF INVENTION

Technical Problem

The technology of Patent Literature 1 targets operations of an air-conditioning apparatus whose indoor unit has one vane. It does not disclose determining a vane to be operated and does not disclose operations for adjusting an air direction, an air volume, and so on from the determined vane for an air-conditioning apparatus whose indoor unit has a plurality of vanes.

An object of the present disclosure is to make it possible to determine a vane to be operated and perform operations for adjusting an air direction, an air volume, and so on from the determined vane for an air-conditioning apparatus whose indoor unit has a plurality of vanes.

Solution to Problem

An air-conditioning operation terminal of the present disclosure includes

- an image acquisition unit to acquire a captured image obtained by capturing an image of an air-conditioning indoor unit including a plurality of vanes;
- an object detection unit to detect the plurality of vanes in the captured image, using a learned model generated by machine learning on training images in each of which an air-conditioning indoor unit of a same type as the air-conditioning indoor unit is captured;
- a vane selection unit to select a target vane from the plurality of vanes in the captured image, the target vane being one vane for which air to be blown is adjusted;
- an image display unit to display, as a superimposed image, the captured image on which a target identification mark for identifying the target vane and an adjustment interface are superimposed, the adjustment interface being a graphical user interface for designating adjustment details for the air to be blown from the target vane;
- a designation acceptance unit to accept adjustment details designated by operating the adjustment interface; and
- an air-conditioning setting unit to set the accepted adjustment details in the air-conditioning indoor unit.

Advantageous Effects of Invention

According to the present disclosure, it is possible to determine a vane to be operated and perform operations for adjusting an air direction, an air volume, and so on from the determined vane for an air-conditioning apparatus whose indoor unit has a plurality of vanes.

BRIEF DESCRIPTION OF DRAWINGS

FIG. 6 is a figure illustrating vane identification data 292 in Embodiment 1;

DESCRIPTION OF EMBODIMENTS

In the embodiments and drawings, the same elements or corresponding elements are denoted by the same reference sign. Description of an element denoted by the same reference sign as that of an element that has been described will be suitably omitted or simplified. Arrows in figures mainly indicate flows of data or flows of processing.

Embodiment 1

An air-conditioning system 100 will be described based on FIGS. 1 to 14.

*Description of Configuration*

Figure 1:
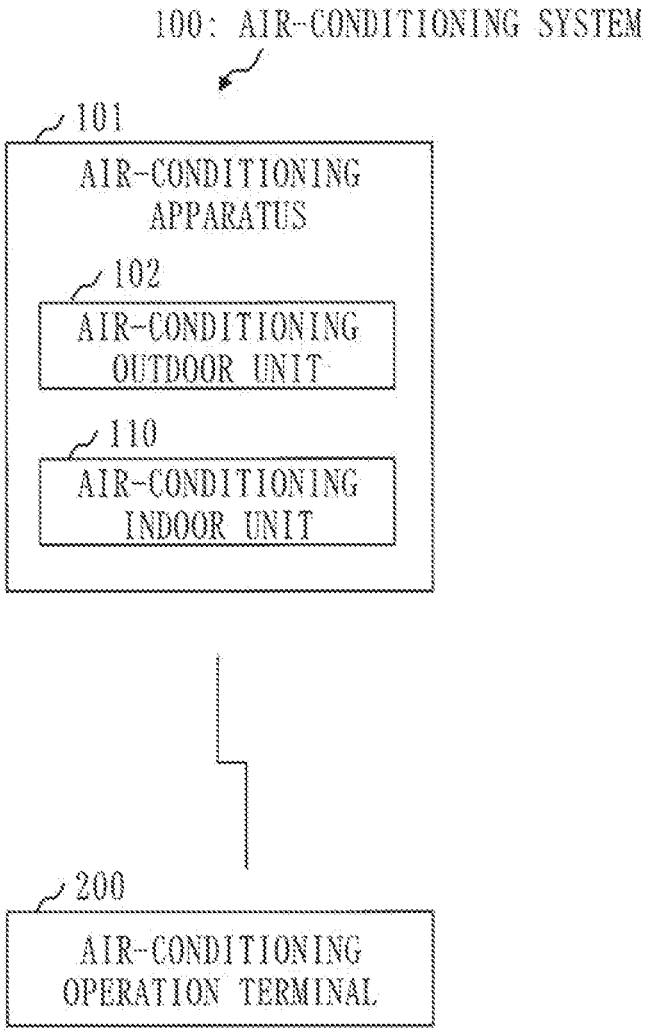
FIG. 1 is a configuration diagram of an air-conditioning system 100 in Embodiment 1.

Based on FIG. 1, a configuration of the air-conditioning system 100 will be described.

The air-conditioning system 100 includes an air-conditioning apparatus 101 and an air-conditioning operation terminal 200.

The air-conditioning apparatus 101 includes an air-conditioning outdoor unit 102 and an air-conditioning indoor unit 110.

The air-conditioning outdoor unit 102 is an outdoor unit of the air-conditioning apparatus 101.

The air-conditioning indoor unit 110 is an indoor unit of the air-conditioning apparatus 101.

The air-conditioning operation terminal 200 is a terminal used for various operations for air-conditioning. For example, a smartphone is used as the air-conditioning operation terminal 200.

The air-conditioning operation terminal 200 communicates wirelessly with the air-conditioning apparatus 101. Specifically, the air-conditioning operation terminal 200 communicates with the air-conditioning indoor unit 110.

Figure 2:
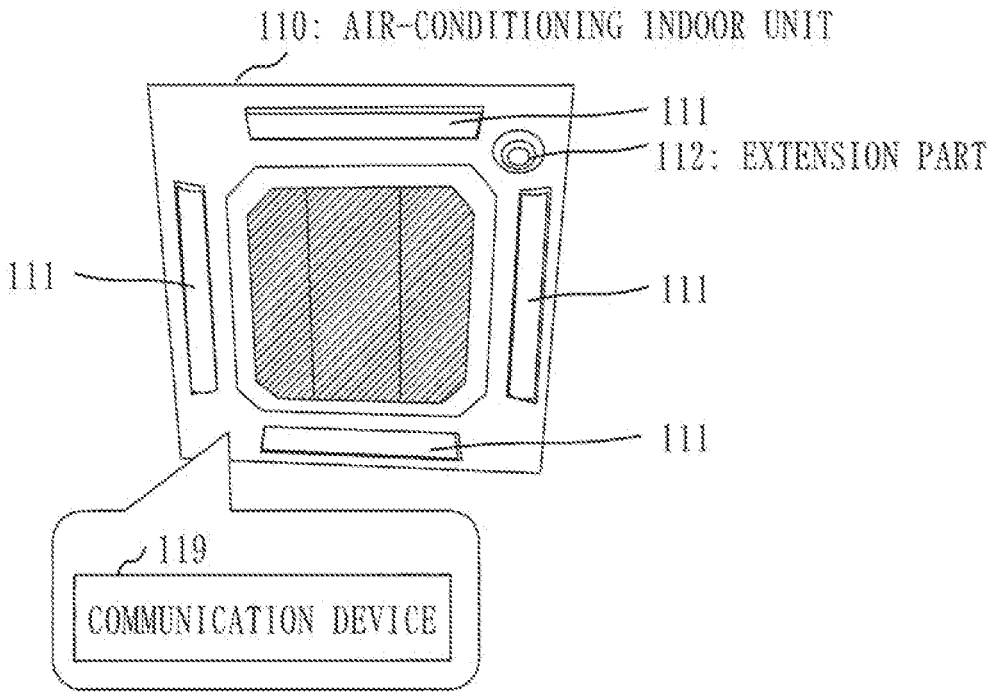
FIG. 2 is a configuration diagram of an air-conditioning indoor unit 110 in Embodiment 1.

Based on FIG. 2, a configuration of the air-conditioning indoor unit 110 will be described.

The air-conditioning indoor unit 110 includes a plurality of vanes 111, an extension part 112, and a communication device 119.

The vanes 111 are openings from which air is blown.

The extension part 112 is a part provided in the air-conditioning indoor unit 110. For example, the extension part 112 is a part equipped with a human detecting sensor, a temperature sensor, and so on.

The communication device 119 is a receiver and a transmitter. For example, the communication device 119 is a communication chip or a NIC. Communication of the air-conditioning indoor unit 110 is performed using the communication device 119.

NIC is an abbreviation for network interface card.

The air-conditioning indoor unit 110 can individually adjust the air to be blown from each of the vanes 111. Specifically, the air-conditioning indoor unit 110 adjusts an air direction, an air volume, and so on for each of the vanes 111.

Adjustable items of the air to be blown (air direction, air volume, etc.) will be referred to as "adjustment items".

Specific details of adjustment will be referred to as "adjustment details". For example, the adjustment details indicate the air direction such as up, down, right, and left, the force of air volume, and so on.

Figure 3:
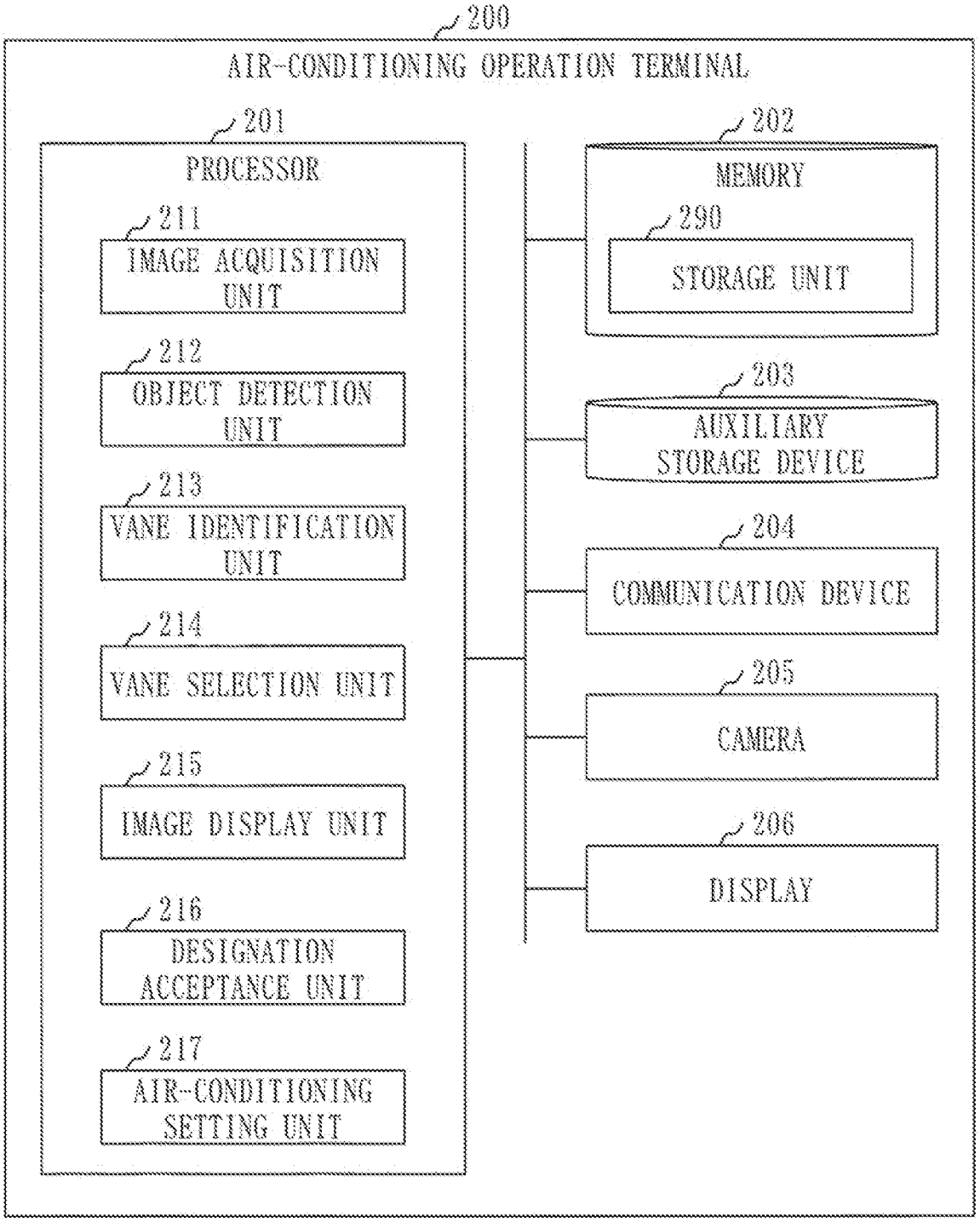
FIG. 3 is a configuration diagram of an air-conditioning operation terminal 200 in Embodiment 1.

Based on FIG. 3, a configuration of the air-conditioning operation terminal 200 will be described.

The air-conditioning operation terminal 200 is a computer that includes hardware such as a processor 201, a memory 202, an auxiliary storage device 203, a communication device 204, a camera 205, and a display 206. These hardware components are connected with one another through signal lines.

The processor 201 is an IC that performs operational processing and controls other hardware components. For example, the processor 201 is a CPU, a DSP, or a GPU.

IC is an abbreviation for integrated circuit.

CPU is an abbreviation for central processing unit.

DSP is an abbreviation for digital signal processor.

GPU is an abbreviation for graphics processing unit.

The memory 202 is a volatile or non-volatile storage device. The memory 202 is also called a main storage device or a main memory. For example, the memory 202 is a RAM. Data stored in the memory 202 is saved in the auxiliary storage device 203 as necessary.

RAM is an abbreviation for random access memory.

The auxiliary storage device 203 is a non-volatile storage device. For example, the auxiliary storage device 203 is a ROM, an HDD, a flash memory, or a combination of these. Data stored in the auxiliary storage device 203 is loaded into the memory 202 as necessary.

ROM is an abbreviation for read only memory.

HDD is an abbreviation for hard disk drive.

The communication device 204 is a receiver and a transmitter. For example, the communication device 204 is a communication chip or a NIC. Communication of the air-conditioning operation terminal 200 is performed using the communication device 204.

The camera 205 is an image-capturing device.

The display 206 is a display device. For example, the display 206 is a touch panel display.

The air-conditioning operation terminal 200 includes elements such as an image acquisition unit 211, an object detection unit 212, a vane identification unit 213, a vane selection unit 214, an image display unit 215, a designation acceptance unit 216, and an air-conditioning setting unit 217. These elements are realized by software.

The auxiliary storage device 203 stores an air-conditioning operation program to cause a computer to function as the image acquisition unit 211, the object detection unit 212, the vane identification unit 213, the vane selection unit 214, the image display unit 215, the designation acceptance unit 216, and the air-conditioning setting unit 217. The air-conditioning operation program is loaded into the memory 202 and executed by the processor 201.

The auxiliary storage device 203 further stores an OS. At least part of the OS is loaded into the memory 202 and executed by the processor 201.

The processor 201 executes the air-conditioning operation program while executing the OS.

OS is an abbreviation for operating system.

Input data and output data of the air-conditioning operation program are stored in a storage unit 290.

The memory 202 functions as the storage unit 290. However, a storage device such as the auxiliary storage device 203, a register in the processor 201, and a cache memory in the processor 201 may function as the storage unit 290 in place of the memory 202 or together with the memory 202.

The air-conditioning operation terminal 200 may include a plurality of processors as an alternative to the processor 201.

The air-conditioning operation program can be recorded (stored) in a computer readable format in a non-volatile recording medium such as an optical disc or a flash memory.

Figure 4:
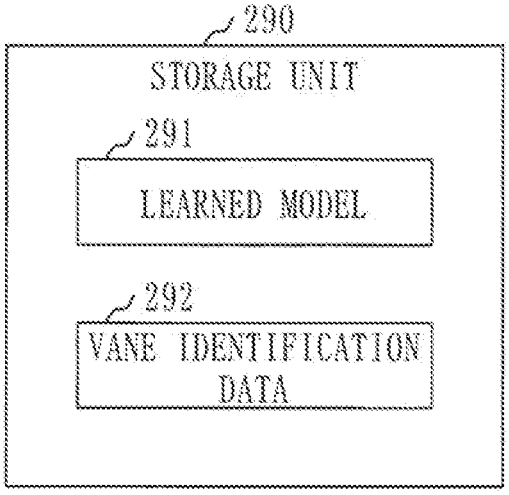
FIG. 4 is a configuration diagram of a storage unit 290 in Embodiment 1.

Based on FIG. 4, a configuration of the storage unit 290 will be described.

The storage unit 290 stores data such as a learned model 291 and vane identification data 292.

Figure 5:
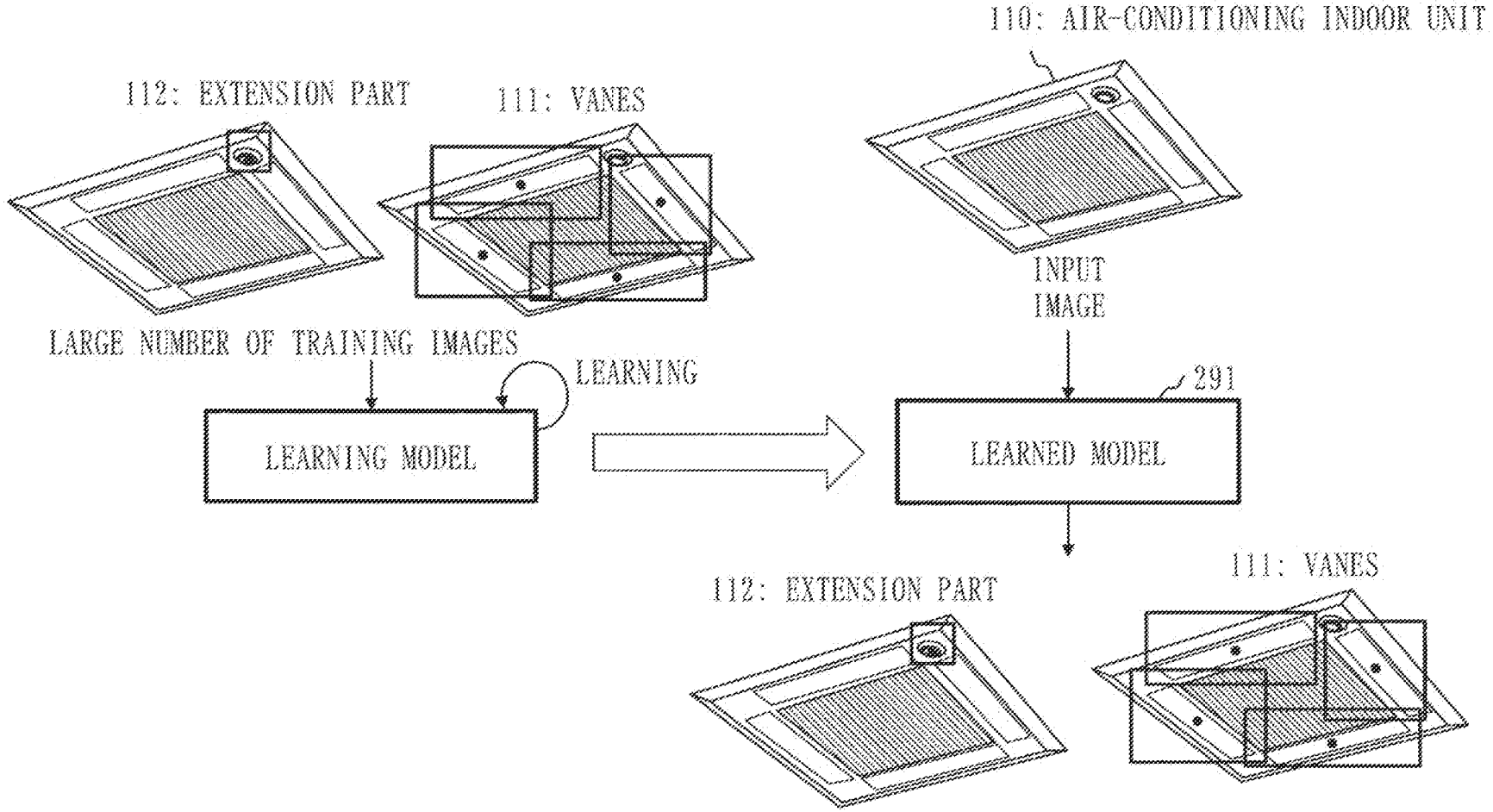
FIG. 5 is a figure describing a learned model 291 in Embodiment 1.

Based on FIG. 5, the learned model 291 will be described.

The learned model 291 is a model for detecting each of the vanes 111 and the extension part 112 in an input image in which the air-conditioning indoor unit 110 is captured.

The learned model 291 is generated by performing machine learning using a plurality of training images as input.

A training image is an image that serves as training data. In each of the training images, an air-conditioning indoor unit of the same type as the air-conditioning indoor unit 110 is captured. The air-conditioning indoor unit that is captured in each of the training images may be the air-conditioning indoor unit 110 or may be a unit different from the air-conditioning indoor unit 110.

It is preferable to provide a large number of training images. In order to improve generalization performance, it is desirable to prepare training images that take into account changes in an indoor lighting environment. Specifically, it is desirable to prepare images with added noise, images with changed brightness, and so on as training images.

For example, the object detection unit 212 accepts at least one training image, generates variations of the training image, and performs machine learning using the accepted training image and the generated training images.

In machine learning, a learning model such as convolutional neural network, YOLO, SSD, or Faster R-CNN is used, for example.

YOLO is an abbreviation for You Only Look Once.

SSD is an abbreviation for Single Shot Multibox Detector.

Faster R-CNN is an abbreviation for Faster Region Convolutional Neural Network.

Specifically, bounding boxes and class classifications are learned in machine learning.

A bounding box is a frame that surrounds an object such as the vane 111 or the extension part 112, and indicates an area where the object is located.

A class classification indicates a type of object such as the vane 111 or the extension part 112.

Based on FIG. 6, the vane identification data 292 will be described.

The vane identification data 292 is data that indicates a positional relationship of each of the vanes 111 with respect to the extension part 112 and an identifier of each of the vanes 111.

Specifically, the vane identification data 292 indicates, for each of the vanes 111, a position number and an identification number in association with each other.

The position number is a number that indicates the positional relationship of the vane 111 with respect to the extension part 112. For example, the position number of the vane 111 to the right of which the extension part 112 is located is "1". Starting from the vane 111 whose position number is "1", the position number of each of the vanes 111 increments by one in clockwise order.

The identification number is a number that identifies the vane 111.

Note that the installation position of the extension part 112 is determined when the air-conditioning indoor unit 110 is installed. If there are a plurality of air-conditioning indoor units 110, the installation position of the extension part 112 may differ in each of the air-conditioning indoor units 110. Therefore, the vane identification data 292 is managed on a per air-conditioning indoor unit 110 basis.

The vane identification data 292 is stored in the storage unit 290 in advance.

However, the vane identification data 292 may be automatically generated by the air-conditioning operation terminal 200.

Methods for automatically generating the vane identification data 292 will be described below.

For example, the air-conditioning operation terminal 200 acquires positional relationship data from the air-conditioning indoor unit 110 through communication. The positional relationship data indicates the positional relationship between the extension part 112 and each of the vanes 111 and the identifier of each of the vanes 111. Then, the air-conditioning operation terminal 200 generates the vane identification data 292 based on position numbers determined by the learned model 291 and the acquired positional relationship data.

For example, the air-conditioning operation terminal 200 recognizes the position number of each of the vanes 111 determined by the learned model 291 as a temporary identification number. Next, the air-conditioning operation terminal 200 operates the air-conditioning indoor unit 110 using the recognized temporary identification numbers. Then, the air-conditioning operation terminal 200 creates the vane identification data 292 based on discrepancies between the vanes 111 that have actually been activated in response to an operation and the temporary identification numbers. In FIG. 6, the temporary identification numbers are the same as the position numbers. Therefore, the discrepancies between the vanes 111 that have actually been activated and the temporary identification numbers are that the numbers are shifted by one. The vane 111 that has been actually activated in response to an operation may be automatically detected by capturing an image of the air-conditioning indoor unit 110 with the camera 205, or may be detected by a user by specifying the vane 111 that has been activated.

*Description of Operation*

A procedure for operation of the air-conditioning operation terminal 200 is equivalent to an air-conditioning operation method. The procedure for operation of the air-conditioning operation terminal 200 is also equivalent to a procedure for processing by the air-conditioning operation program.

Figure 7:
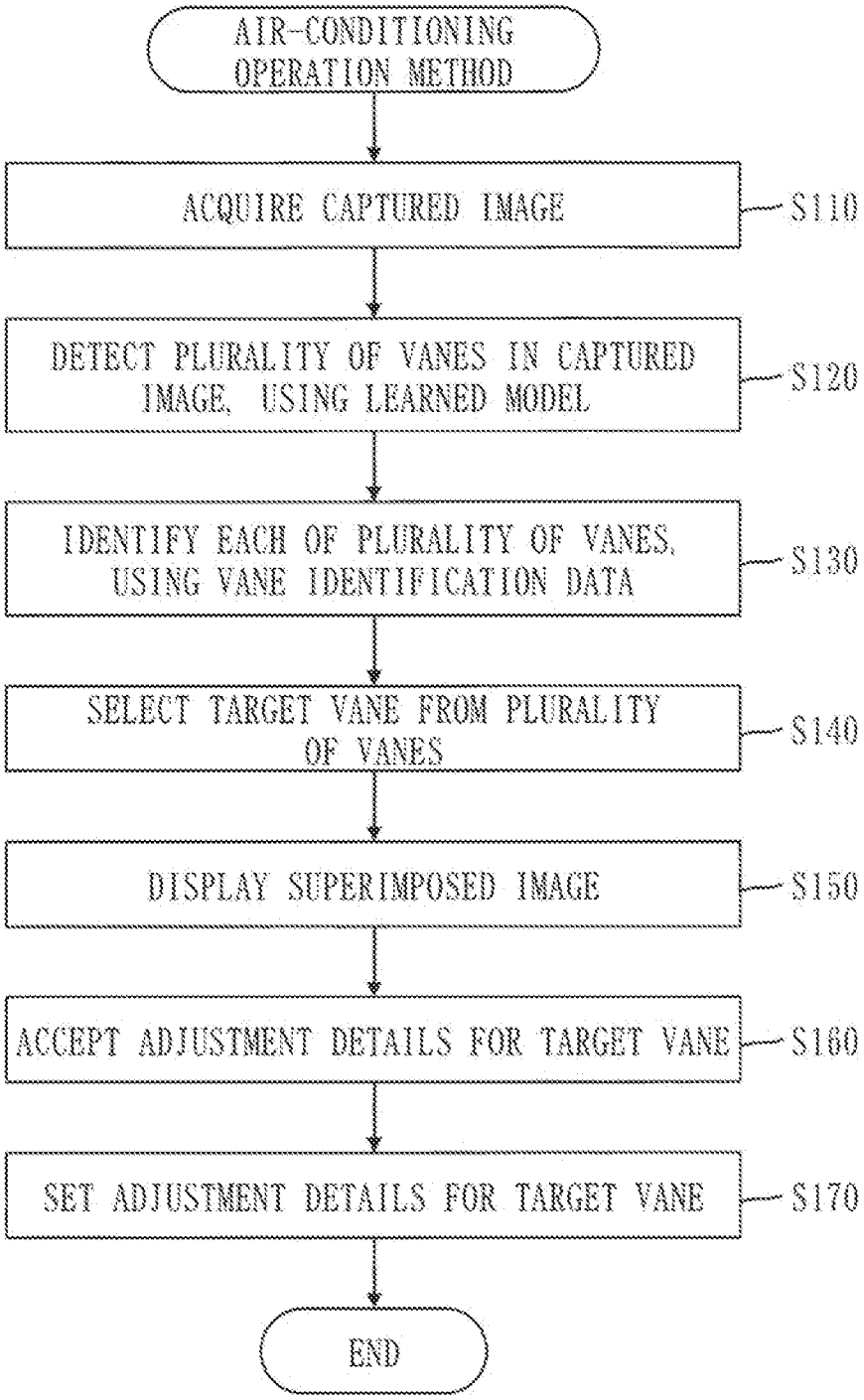
FIG. 7 is a flowchart of an air-conditioning operation method in Embodiment 1.

Based on FIG. 7, an air-conditioning operation method will be described.

In step S110, a user operates the camera 205 of the air-conditioning operation terminal 200 to capture an image of the air-conditioning indoor unit 110.

The camera 205 captures an image of the air-conditioning indoor unit 110 in accordance with an operation of the user and outputs the image. The image obtained by capturing an image will be referred to as a "captured image 281".

The image acquisition unit 211 acquires the captured image 281 from the camera 205, and stores the captured image 281 in the storage unit 290.

Figure 8:
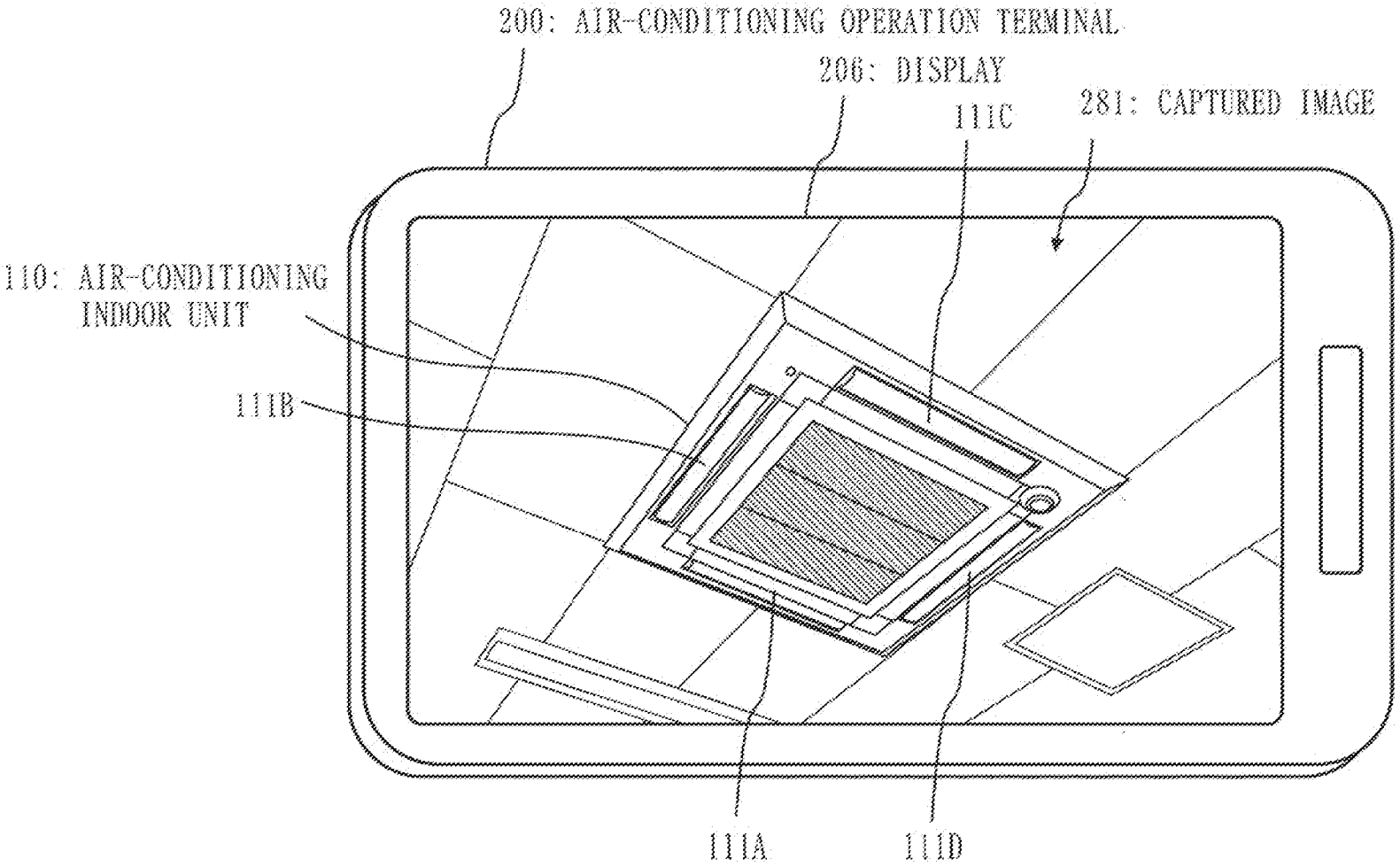
FIG. 8 is a figure illustrating a captured image 281 in Embodiment 1.

Based on FIG. 8, a specific example of the captured image 281 will be described.

The captured image 281 is displayed on the display 206 of the air-conditioning operation terminal 200.

In the captured image 281, the air-conditioning indoor unit 110 is captured. The air-conditioning indoor unit 110 has four vanes (111A to 111D). That is, in the captured image 281, the air-conditioning indoor unit 110 with the four vanes (111A to 111D) is captured.

Referring back to FIG. 7, the description will be continued from step S120.

In step S120, the object detection unit 212 detects the plurality of vanes 111 in the captured image 281, using the learned model 291.

Specifically, the object detection unit 212 calculates the learned model 291, using the captured image 281 as input. As a result, the plurality of vanes 111 and the extension part 112 are detected.

Figure 9:
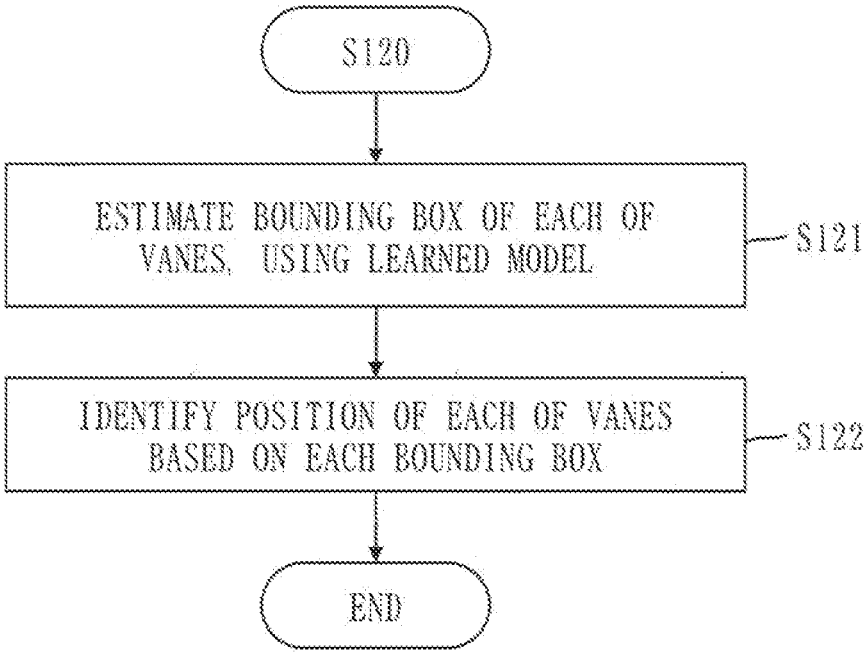
FIG. 9 is a flowchart of step S120 in Embodiment 1.

Based on FIG. 9, a procedure for step S120 will be described.

In step S121, the object detection unit 212 estimates bounding boxes individually for each of the vanes 111 and the extension part 112, using the learned model 291.

In step S122, the object detection unit 212 determines positions of each of the vanes 111 and the extension part 112 individually based on the bounding boxes.

For example, the object detection unit 212 calculates the center of a bounding box. The calculated center is the determined position.

Referring back to FIG. 7, the description will be continued from step S130.

In step S130, the vane identification unit 213 determines a positional relationship of each of the vanes 111 with respect to the extension part 112 in the captured image 281, and identifies each of the vanes 111 based on the determined positional relationship.

Specifically, the vane identification unit 213 identifies the identifier of each of the vanes 111, using the vane identification data 292.

Figure 10:
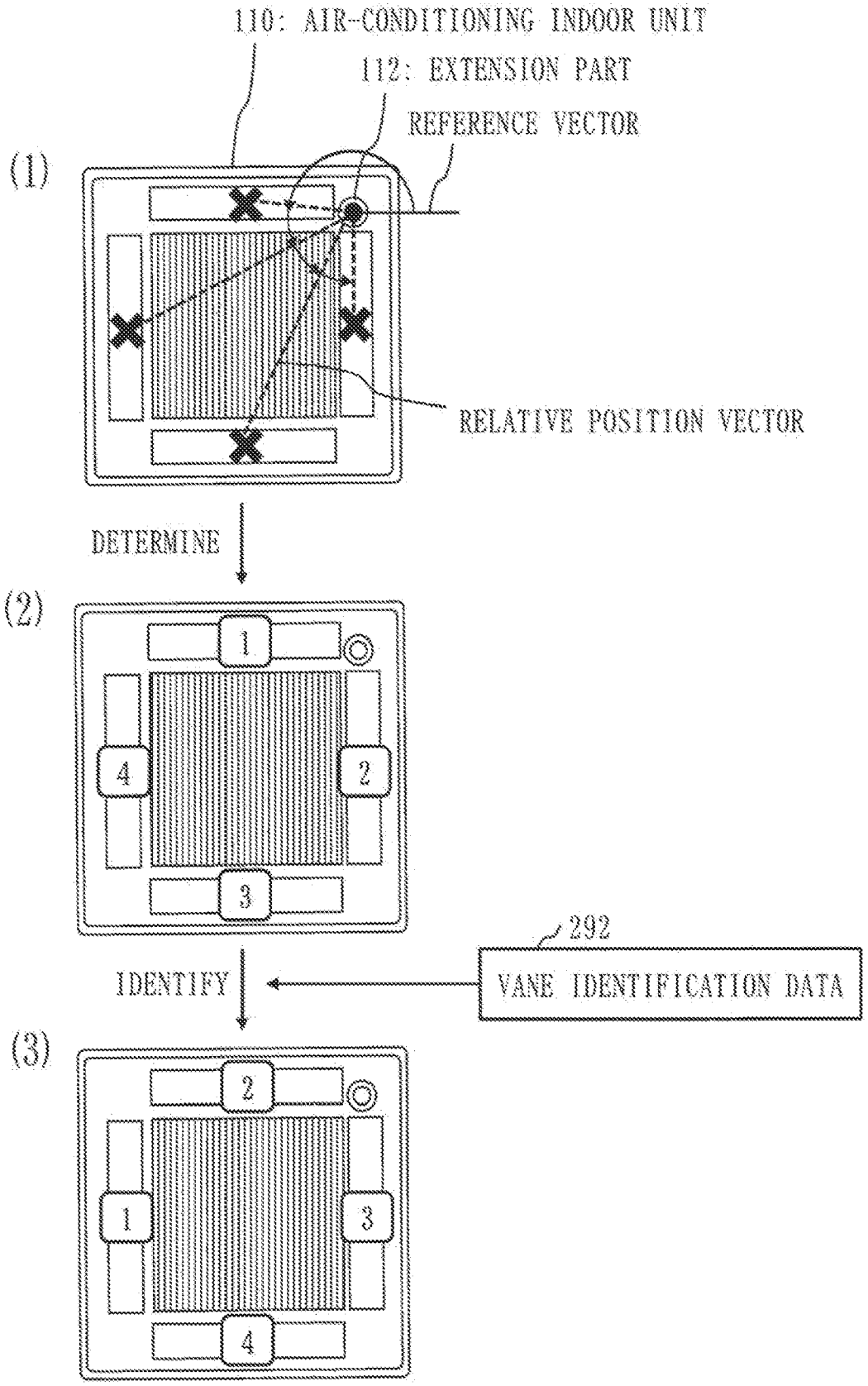
FIG. 10 is a figure describing step S130 in Embodiment 1.

Based on FIG. 10, details of step S130 will be described.

A vector that indicates a reference direction with the extension part 112 as a base point will be referred to as a "reference vector". Specifically, the reference direction is a rightward direction when the extension part 112 is located at the upper right.

A vector from the extension part 112 to each of the vanes 111 will be referred to as a "relative position vector".

(1) First, the vane identification unit 213 calculates a relative angle of the relative position vector with respect to the reference vector for each of the vanes 111. The calculated relative angle is a rotation angle when the reference vector is rotated counterclockwise from the base point that is the extension part 112 until it overlaps with the relative position vector.

(2) Next, the vane identification unit 213 determines the position number of each of the vanes 111 based on the relative angle of each of the vanes 111.

Specifically, the vane identification unit 213 selects the vane 111 with the smallest relative angle, and assigns a position number "1" to the selected vane 111. Further, the vane identification unit 213 selects the remaining vanes 111 one by one in descending order of the relative angle, and assigns a position number to each of the selected vanes 111 sequentially starting from "2".

(3) Then, the vane identification unit 213 acquires the identification number corresponding to the position number from the vane identification data 292 for each of the vanes 111.

Referring back to FIG. 7, the description will be continued from step S140.

In step S140, the vane selection unit 214 selects one vane 111 from the plurality of vanes 111 in the captured image 281. The selected vane 111 will be referred to as a "target vane 113".

The target vane 113 is the vane 111 for which the air to be blown is adjusted.

Figure 11:
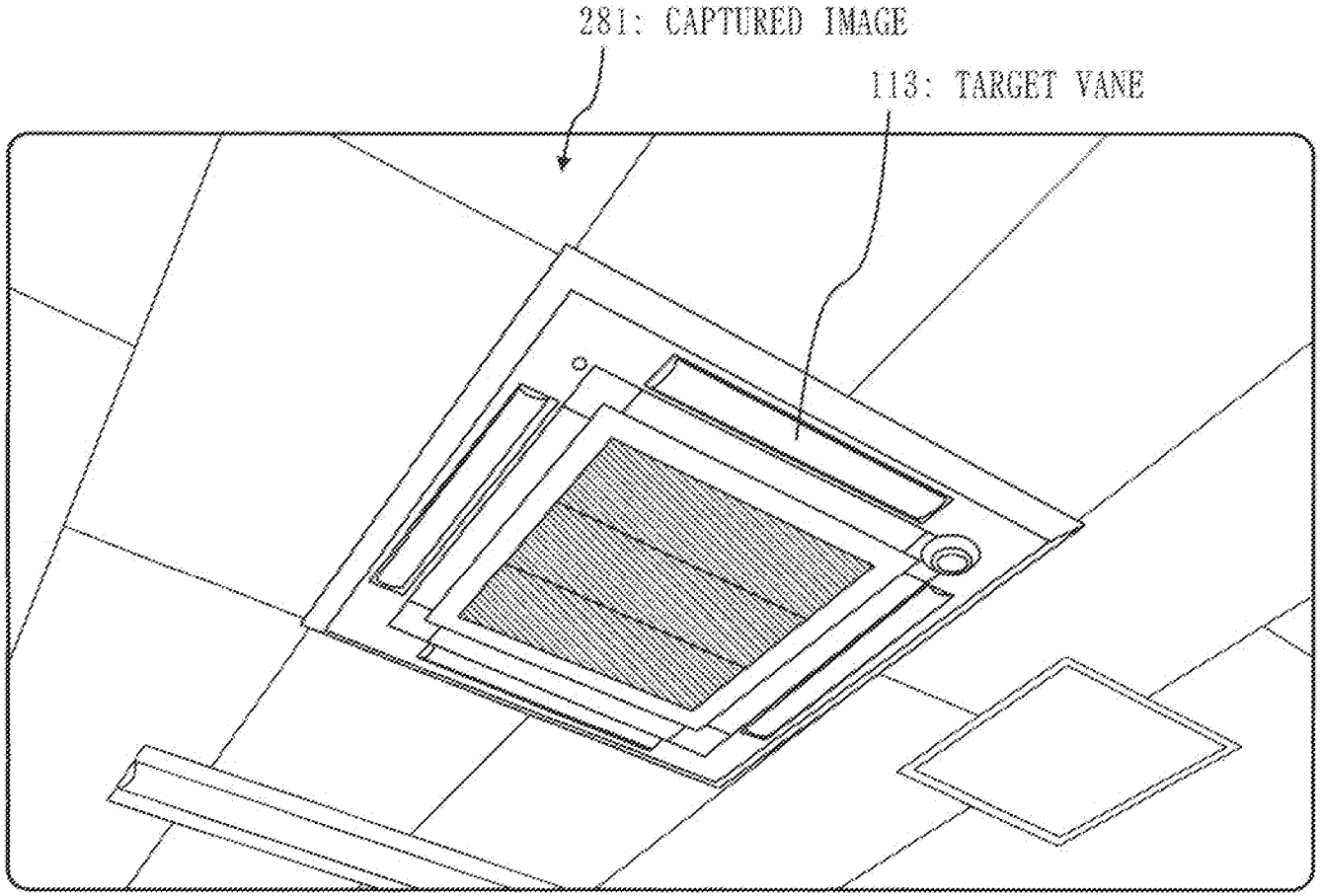
FIG. 11 is a figure describing a target vane 113 in Embodiment 1.

Based FIG. 11, a specific example of the target vane 113 will be described.

It is considered that the air blown from the vane 111 closest to the user reaches the user and has a significant influence on the user.

The vane 111 located at the uppermost position in the captured image 281 is considered to be the vane 111 closest to the user.

Therefore, the vane selection unit 214 selects the vane 111 located at the uppermost position in the captured image 281 as the target vane 113.

Referring back to FIG. 7, the description will be continued from step S150.

In step S150, the image display unit 215 uses the captured image 281 to generate a superimposed image 282, and displays the superimposed image 282 on the display 206.

Based on FIG. 12, the superimposed image 282 will be described.

The superimposed image 282 is the captured image 281 on which a target identification mark 283 and an adjustment interface 284 are superimposed.

The target identification mark 283 is a mark for identifying the target vane 113. The target identification mark 283 is superimposed at the position of the target vane 113.

The adjustment interface 284 is a graphical user interface (GUI) for designating adjustment details for the air blown from the target vane 113.

The adjustment interface 284 includes a GUI for each type of adjustment. The types of adjustment include an upward/downward air direction, a rightward/leftward air direction, an air volume, and an operating mode.

GUIs such as icons (see FIG. 12) or sliders are used for the adjustment interface 284.

Figure 12:
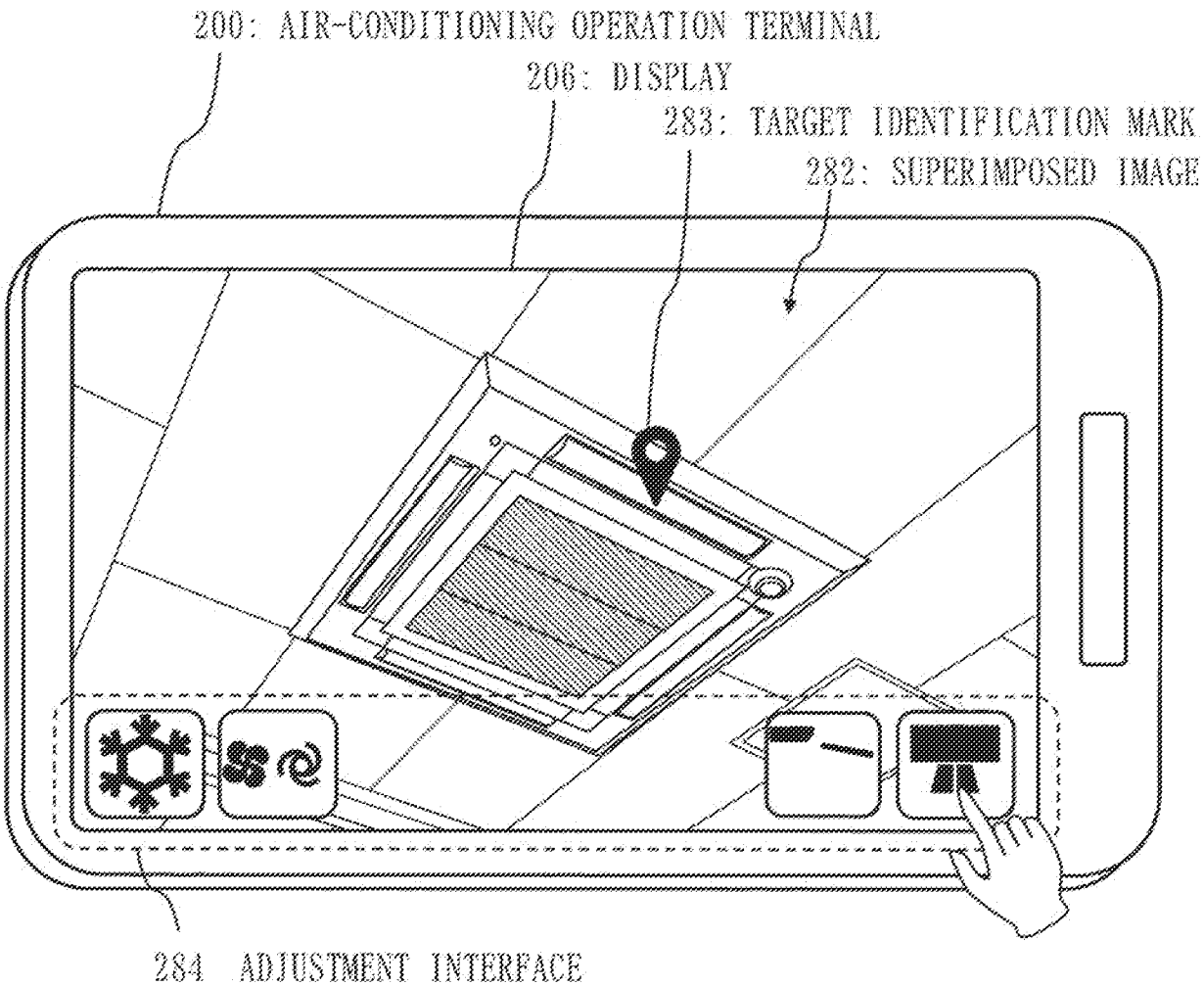
FIG. 12 is a figure illustrating a superimposed image 282 in Embodiment 1.

The adjustment interface 284 is superimposed at the bottom side of the superimposed image 282 in FIG. 12. However, the position at which the adjustment interface 284 is superimposed is not limited to the position indicated in FIG. 12.

Referring back to FIG. 7, the description will be continued from step S160.

In step S160, the user specifies adjustment details for the target vane 113 by operating the adjustment interface 284.

Then, the designation acceptance unit 216 accepts the adjustment details for the target vane 113.

In step S170, the air-conditioning setting unit 217 communicates with the air-conditioning indoor unit 110 to set the adjustment details for the target vane 113 in the air-conditioning indoor unit 110.

Specifically, the air-conditioning setting unit 217 transmits a setting request that indicates the identifier of the target vane 113 and the adjustment details for the target vane 113 to the air-conditioning indoor unit 110. The air-conditioning indoor unit 110 receives the setting request. Then, the air-conditioning indoor unit 110 sets the adjustment details indicated in the setting request for the vane 111 identified by the identifier indicated in the setting request.

Then, the air-conditioning indoor unit 110 adjusts the air blown from the target vane 113 in accordance with the adjustment details that have been set.

Description of Implementation Example

Based on FIGS. 13 and 14, an implementation example will be described.

Figure 13:
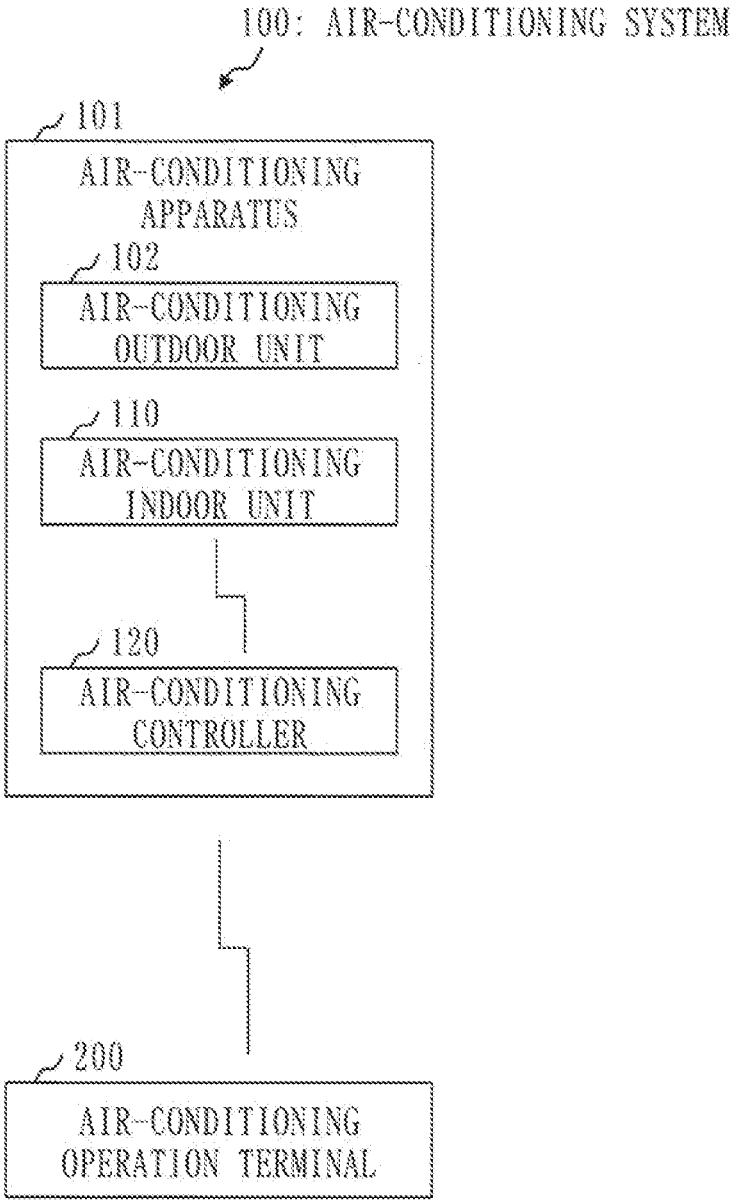
FIG. 13 is a figure illustrating an example of a configuration of the air-conditioning system 100 in Embodiment 1.

As illustrated in FIG. 13, the air-conditioning apparatus 101 may include an air-conditioning controller 120.

The air-conditioning controller 120 is a remote control for controlling the air-conditioning indoor unit 110. The air-conditioning controller 120 may be either one of a wired remote control and a wireless remote control.

The air-conditioning controller 120 is connected to the air-conditioning indoor unit 110 by wire or wirelessly, and controls the air-conditioning indoor unit 110. When the air-conditioning controller 120 is connected to the air-conditioning indoor unit 110 by wire, the communication device 119 of the air-conditioning indoor unit 110 is not required.

Figure 14:
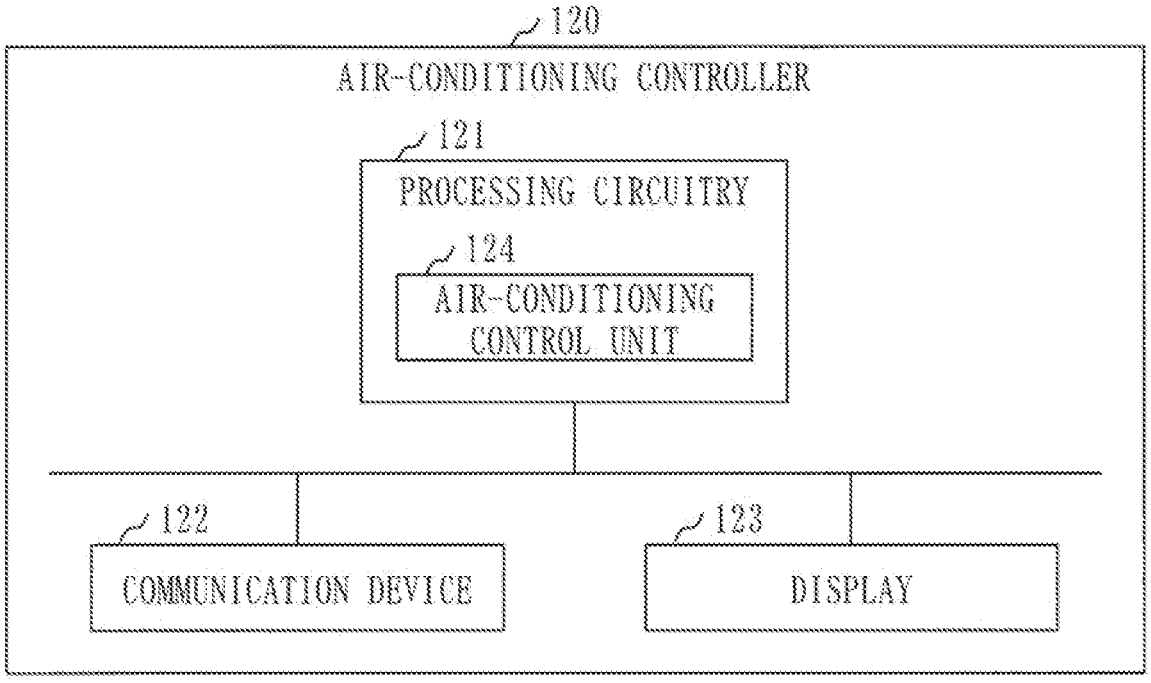
FIG. 14 is a figure illustrating an example of a configuration of an air-conditioning controller 120 in Embodiment 1.

FIG. 14 illustrates a configuration of the air-conditioning controller 120.

The air-conditioning controller 120 includes hardware such as processing circuitry 121, a communication device 122, and a display 123. These hardware components are connected with one another through signal lines.

The processing circuitry 121 is hardware that realizes an air-conditioning control unit 124.

The communication device 122 is a receiver and a transmitter. For example, the communication device 122 is a communication chip or a NIC. Communication of the air-conditioning controller 120 is performed using the communication device 122.

The display 123 is a display device. For example, the display 123 is a liquid crystal display or a touch panel display.

The processing circuitry 121 will be described in detail.

The processing circuitry 121 may be dedicated hardware, or may be a processor that executes programs stored in a memory.

When the processing circuitry 121 is dedicated hardware, the processing circuitry 121 is, for example, a single circuit, a composite circuit, a programmed processor, a parallel-programmed processor, an ASIC, an FPGA, or a combination of these.

ASIC is an abbreviation for application specific integrated circuit.

FPGA is an abbreviation for field programmable gate array.

The air-conditioning controller 120 may include a plurality of processing circuitry as an alternative to the processing circuitry 121.

In the processing circuitry 121, some functions may be realized by hardware, and the remaining functions may be realized by software or firmware.

When the air-conditioning apparatus 101 includes the air-conditioning controller 120, step S170 (see FIG. 7) is executed as described below.

In step S170, the air-conditioning setting unit 217 transmits data that indicates adjustment details for the target vane 113 to the air-conditioning controller 120. The air-conditioning control unit 124 receives the transmitted data.

Then, the air-conditioning control unit 124 communicates with the air-conditioning indoor unit 110 to set the adjustment details for the target vane 113 in the air-conditioning indoor unit 110.

The identification number of each of the vanes 111 may be identified without using the vane identification data 292.

For example, the air-conditioning operation terminal 200 may acquire positional relationship data from the air-conditioning indoor unit 110 through communication. The positional relationship data indicates a positional relationship between the extension part 112 and each of the vanes 111 and an identifier of each of the vanes 111. The air-conditioning operation terminal 200 identifies the identification number of each of the vanes 111 based on the position numbers determined by the learned model 291 and the acquired positional relationship data.

For example, the air-conditioning operation terminal 200 recognizes the position number of each of the vanes 111 determined by the learned model 291 as a temporary identification number. Next, the air-conditioning operation terminal 200 operates the air-conditioning indoor unit 110 using the recognized temporary identification numbers. Then, the air-conditioning operation terminal 200 identifies the identification numbers of the vanes 111 based on discrepancies between the vanes 111 that have actually been activated in response to an operation and the temporary identification numbers. The vane 111 that has actually been activated in response to an operation may be automatically detected by capturing an image of the air-conditioning indoor unit 110 with the camera 205, or may be detected by the user by specifying the vane 111 that has been activated.

Effects of Embodiment 1

Embodiment 1 makes it possible to determine the vane 111 to be operated and perform operations for adjusting the air direction, air volume, and so on for the air-conditioning apparatus 101 whose indoor unit has the plurality of vanes 111.

Specifically, when an image of the air-conditioning indoor unit 110 is captured, the plurality of vanes 111 are individually identified in the image obtained by capturing an image, and the target vane 113 is determined. This makes it possible to perform operations for adjusting the air direction, air volume, and so on of the target vane 113 for the air-conditioning apparatus 101 whose indoor unit has the plurality of vanes 111.

Embodiment 2

With regard to an embodiment in which two or more vanes 111 that are candidates for the target vane 113 are presented, and one vane 111 selected from the candidates is treated as the target vane 113, differences from Embodiment 1 will be mainly described based on FIGS. 15 to 18.

*Description of Configuration*

The configuration of the air-conditioning system 100 is the same as the configuration in Embodiment 1.

*Description of Operation*

Figure 15:
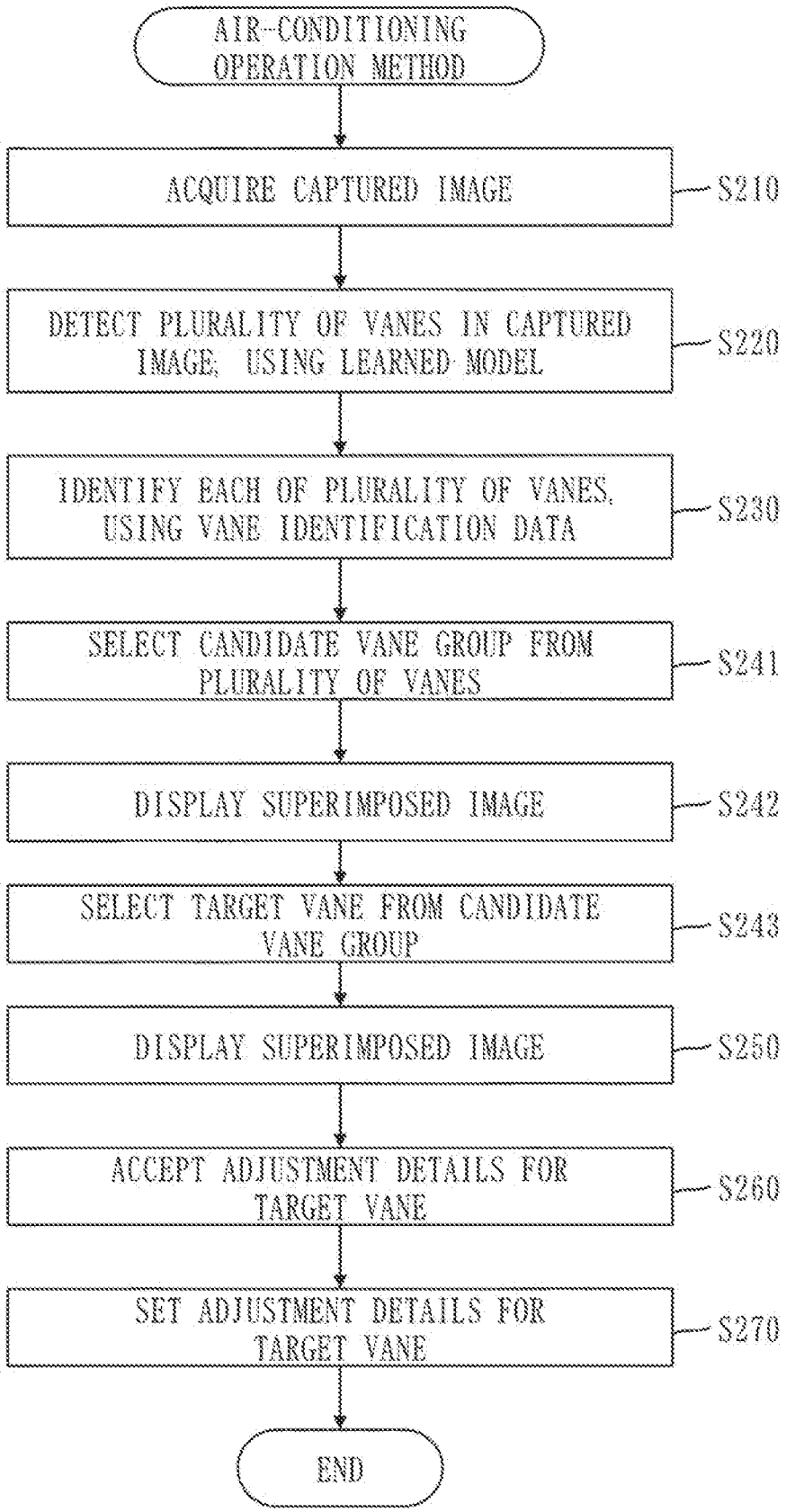
FIG. 15 is a flowchart illustrating an air-conditioning operation method in Embodiment 2.

Based on FIG. 15, an air-conditioning operation method will be described.

Step S210 to step S230 are the same as step S110 to step S130 in Embodiment 1.

After step S230, processing proceeds to step S241.

In step S241, the vane selection unit 214 selects two or more vanes 111 from the plurality of vanes 111 in the captured image 281. The selected vanes 111 will be referred to as a "candidate vane group 114".

The candidate vane group 114 is two or more vanes 111 that are candidates for the target vane 113.

Figure 16:
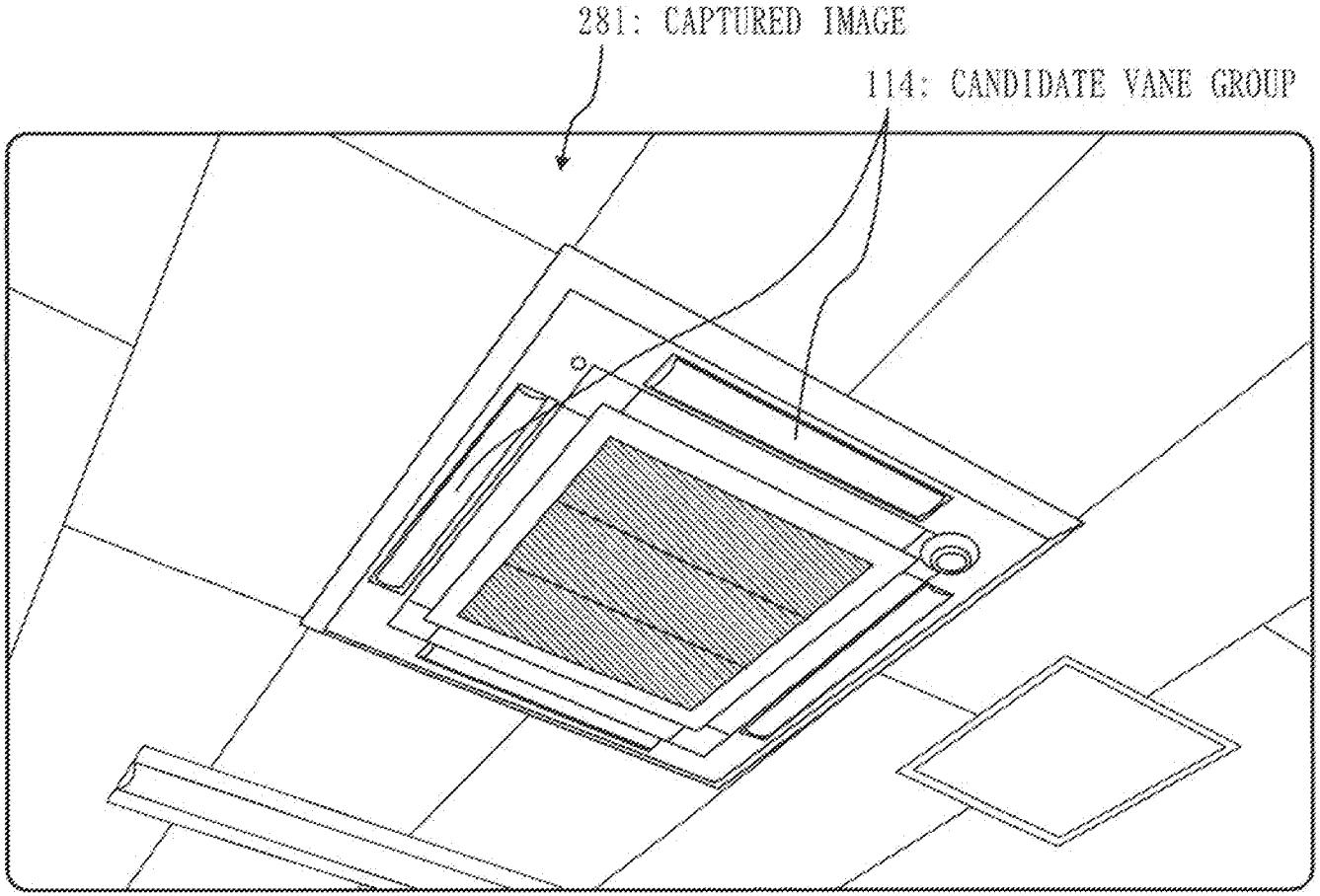
FIG. 16 is a figure illustrating a candidate vane group 114 in Embodiment 2.

Based on FIG. 16, a specific example of the candidate vane group 114 will be described.

It is considered that the air blown from the vane 111 close to the user reaches the user and has a significant influence on the user.

It is considered that the upper the position of the vane 111 in the captured image 281, the closer it is to the user.

Therefore, the vane selection unit 214 selects two vanes 111 located at the uppermost and second uppermost positions in the captured image 281 as the candidate vane group 114.

Referring back to FIG. 15, the description will be continued from step S242.

In step S242, the image display unit 215 uses the captured image 281 to generate a superimposed image 285, and displays the superimposed image 285 on the display 206.

Figure 17:
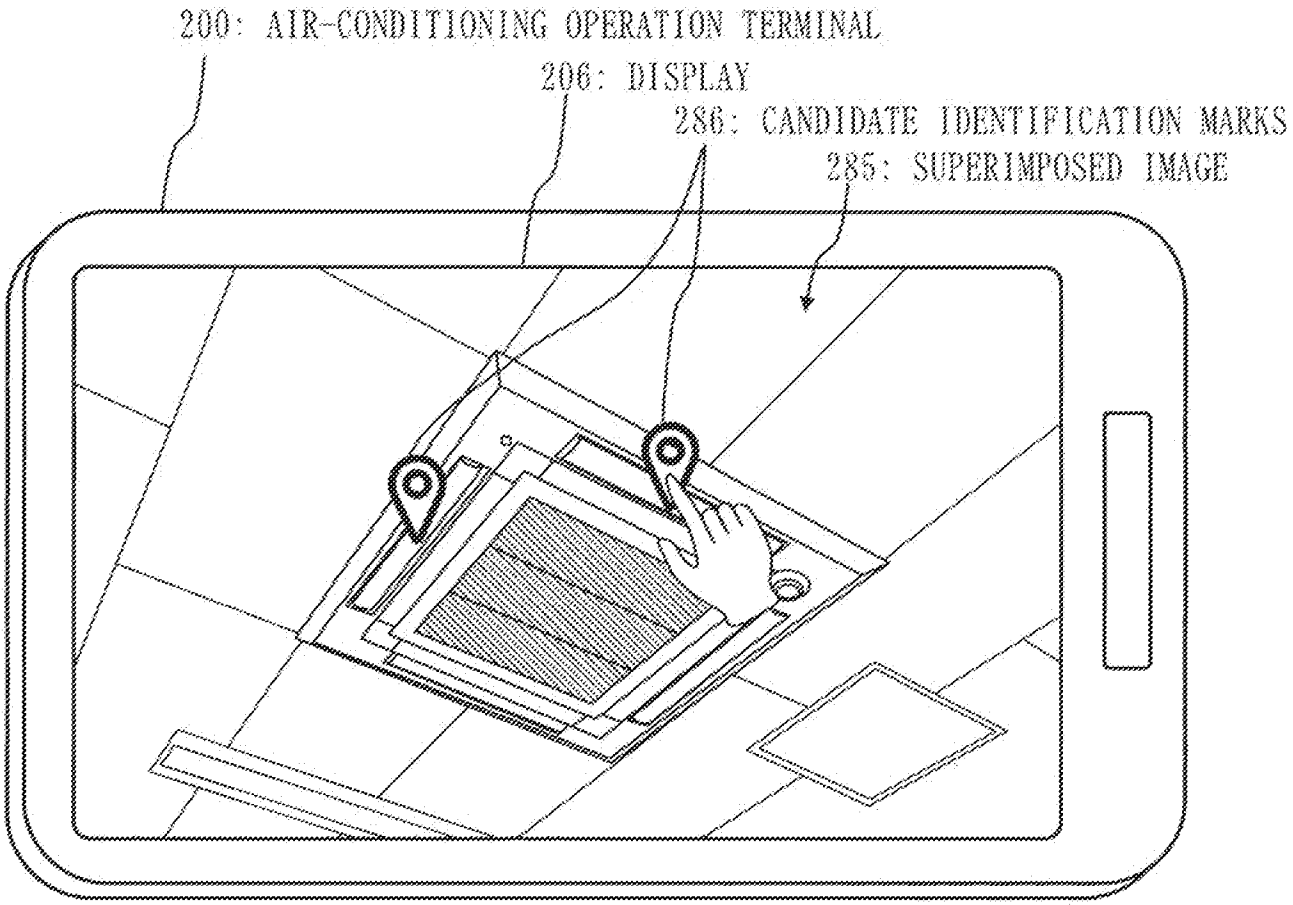
FIG. 17 is a figure illustrating a superimposed image 285 in Embodiment 2.

Based on FIG. 17, the superimposed image 285 will be described.

The superimposed image 285 is the captured image 281 on which a candidate identification mark group is superimposed.

The candidate identification mark group is two or more candidate identification marks 286 corresponding to the two or more vanes 111 constituting the candidate vane group 114.

The candidate identification marks 286 are marks for identifying the vanes 111 of the candidate vane group 114. The candidate identification marks 286 are superimposed at the positions of the vanes 111 of the candidate vane group 114.

Referring back to FIG. 15, the description will be continued from step S243.

In step S243, the user designates the identifier of one vane 111 by selecting the candidate identification mark 286 of one vane 111 to be the target vane 113.

The designation acceptance unit 216 accepts the identifier of the one vane 111.

The vane selection unit 214 selects the one vane 111 identified by the accepted identifier from the candidate vane group 114. The selected vane 111 is the target vane 113.

After step S243, processing proceeds to step S250.

In step S250, the image display unit 215 uses the captured image 281 to generate a superimposed image 282, and displays the superimposed image 282 on the display 206.

Step S250 corresponds to step S150 in Embodiment 1.

Figure 18:
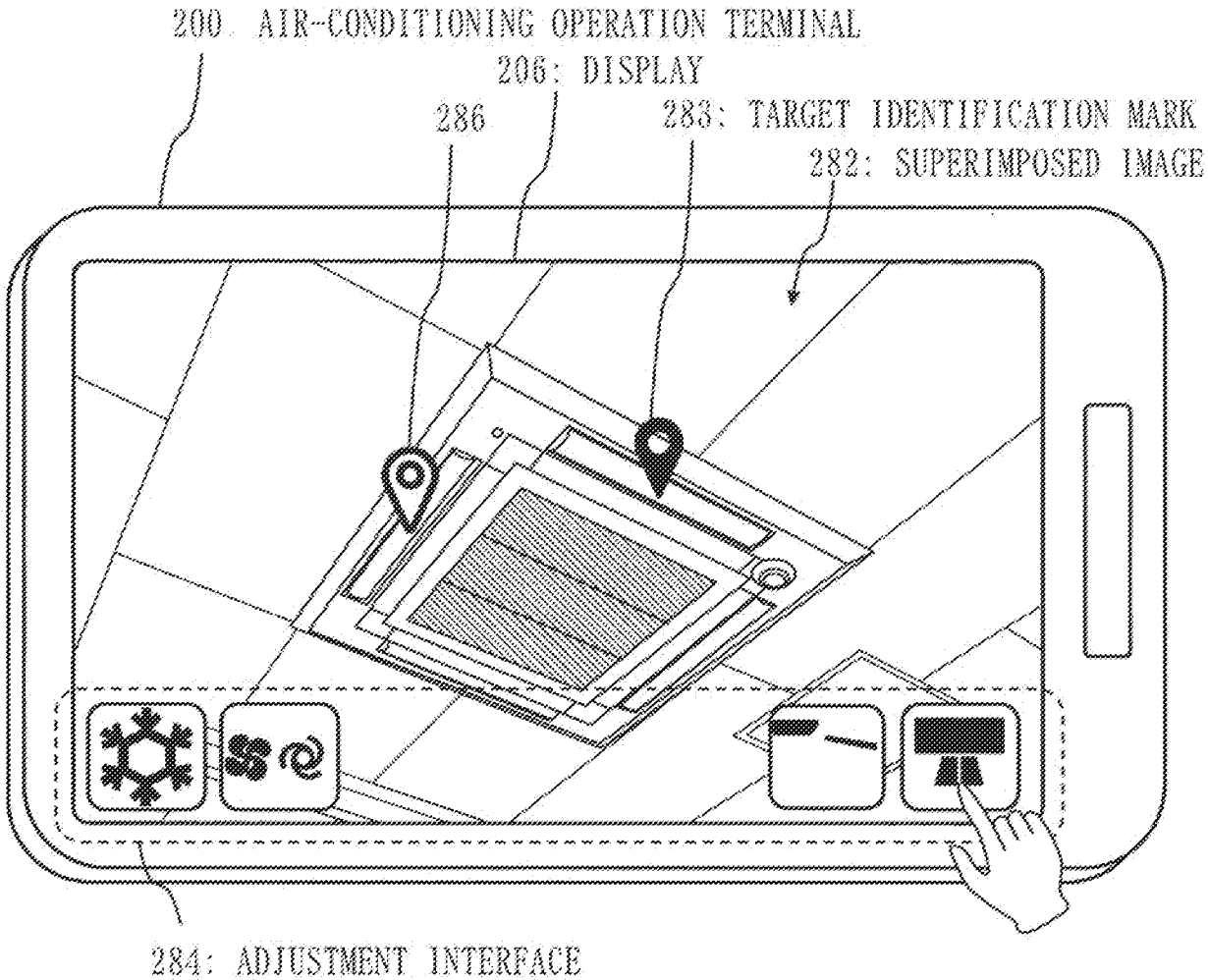
FIG. 18 is a figure illustrating a superimposed image 282 in Embodiment 2.

FIG. 18 illustrates a specific example of the superimposed image 282.

In the superimposed image 282, the candidate identification mark 286 of the vane 111 that is not selected as the target vane 113 may be superimposed.

Referring back to FIG. 15, the description will be continued from step S260.

Step S260 and step S270 are the same as step S160 and step S170 in Embodiment 1.

Effects of Embodiment 2

In Embodiment 2, when an image of the air-conditioning indoor unit 110 is captured, each of the plurality of vanes 111 is identified in the image obtained by capturing an image, and the candidate vane group 114 is determined. In addition, the designation acceptance unit 216 accepts designation of the vane 111.

This makes it possible to perform operations for designating the target vane 113 from the candidate vane group 114 and adjusting the air direction, air volume, and so on of the target vane 113 for the air-conditioning apparatus 101 whose indoor unit has the plurality of vanes 111.

Embodiment 3

With regard to an embodiment in which a state of the air blown from the target vane 113 is displayed, differences from Embodiment 1 will be mainly described based on FIGS. 19 to 24.

*Description of Configuration*

The configuration of the air-conditioning system 100 is substantially the same as the configuration in Embodiment 1.

However, the configuration of the air-conditioning operation terminal 200 is different from the configuration in Embodiment 1.

Figure 19:
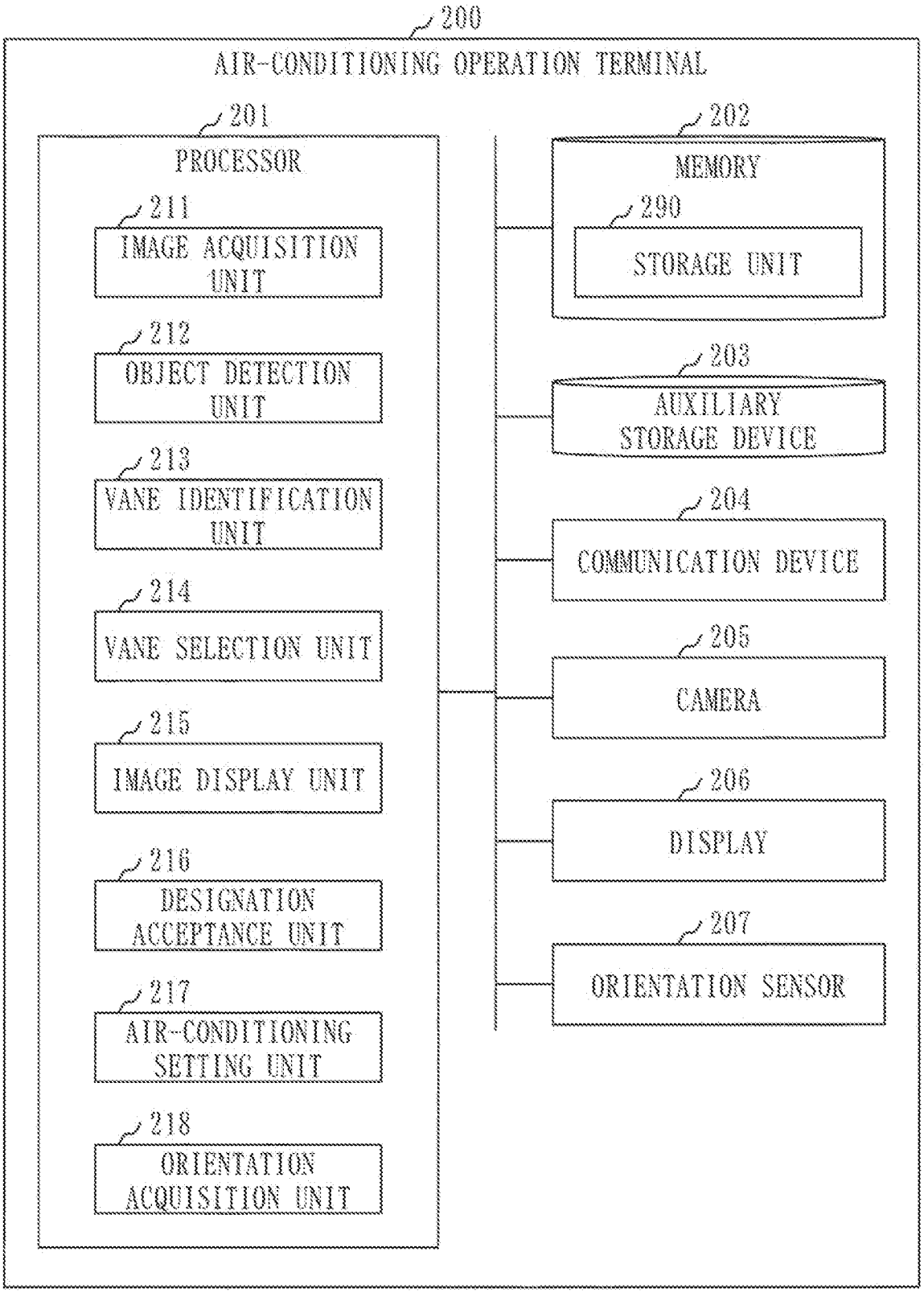
FIG. 19 is a configuration diagram of the air-conditioning operation terminal 200 in Embodiment 3.

Based on FIG. 19, the configuration of the air-conditioning operation terminal 200 will be described.

The air-conditioning operation terminal 200 further includes hardware called an orientation sensor 207.

The orientation sensor 207 is a sensor to measure an orientation of the air-conditioning operation terminal 200. For example, the orientation sensor 207 is an acceleration sensor, a gyroscope, and the like.

The air-conditioning operation terminal 200 further includes an element called an orientation acquisition unit 218.

The air-conditioning operation program further causes a computer to function as the orientation acquisition unit 218.

*Description of Operation*

Figure 20:
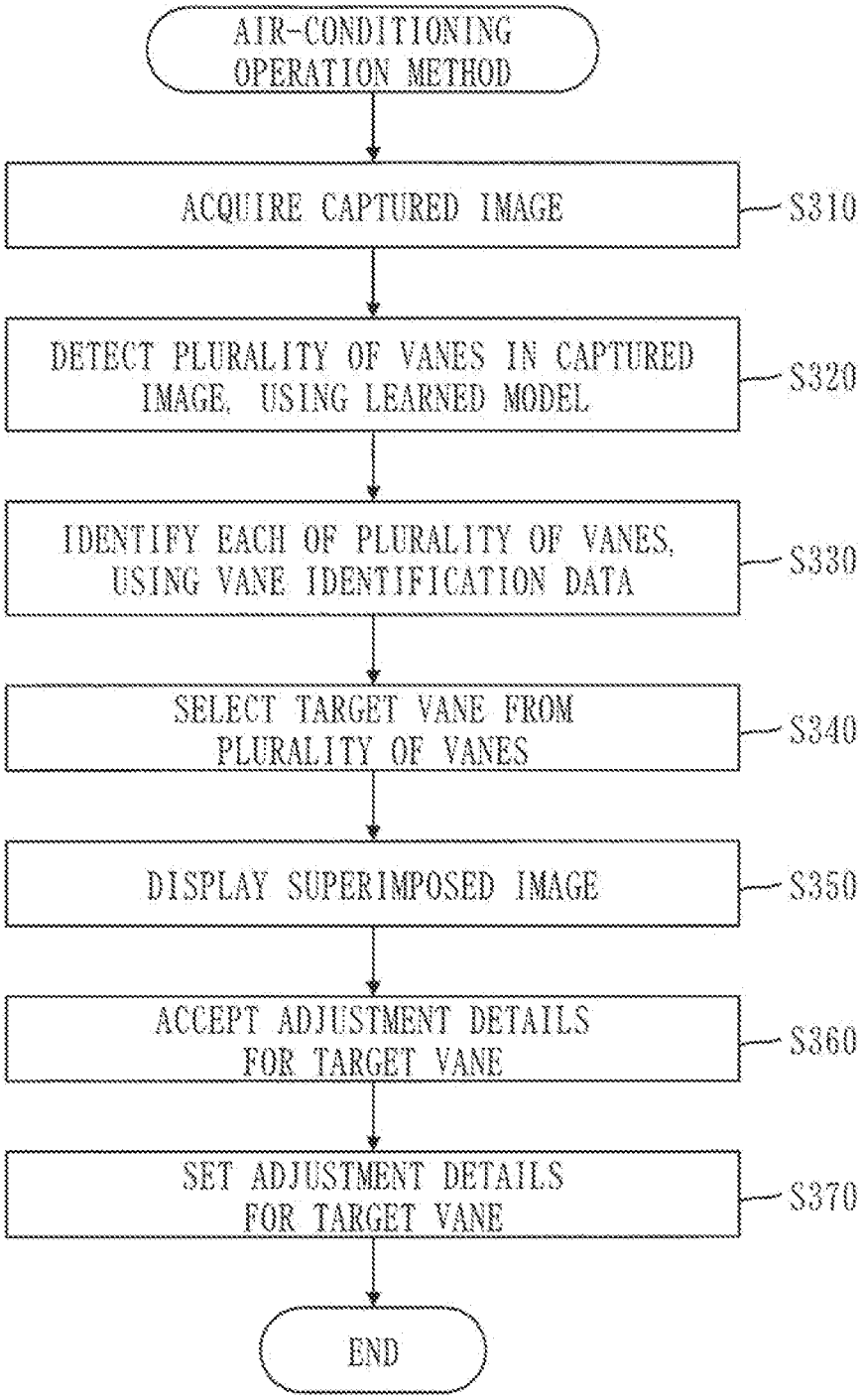
FIG. 20 is a flowchart of an air-conditioning operation method in Embodiment 3.

Based on FIG. 20, an air-conditioning operation method will be described.

In step S310, the image acquisition unit 211 acquires a captured image 281 from the camera 205. This processing is the same as step S110 in Embodiment 1.

Furthermore, the orientation acquisition unit 218 acquires a terminal orientation from the orientation sensor 207.

The terminal orientation is data that indicates the orientation of the air-conditioning operation terminal 200.

Figure 21:
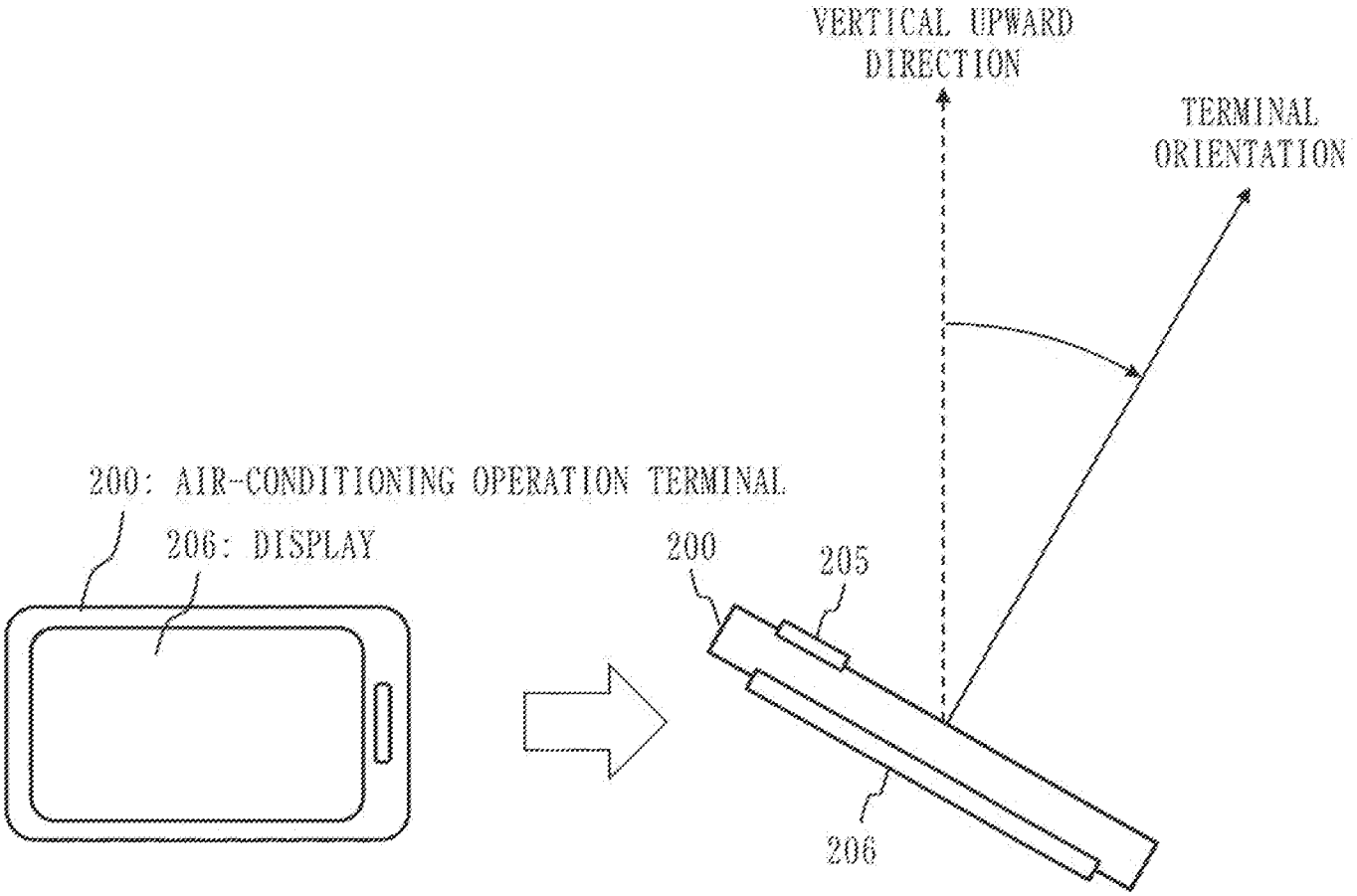
FIG. 21 is a figure illustrating a terminal orientation in Embodiment 3.

As illustrated in FIG. 21, the terminal orientation is represented by an angle formed by a direction perpendicular to a flat surface of the air-conditioning operation terminal 200 and a vertical upward direction.

Referring back to FIG. 20, the description will be continued from step S320.

In step S320, the object detection unit 212 detects the plurality of vanes 111 in the captured image 281, using the learned model 291.

Step S320 is the same as step S120 in Embodiment 1.

In step S320, bounding boxes of the plurality of vanes 111 are individually estimated.

Step S330 and step S340 are the same as step S130 and step S140 in Embodiment 1.

In step S350, the image display unit 215 uses the captured image 281 to generate a superimposed image 282, and displays the superimposed image 282 on the display 206.

The superimposed image 282 is the captured image 281 on which a state interface 287 and the adjustment interface 284 are superimposed.

The state interface 287 is a graphical user interface (GUI) that indicates a state of the air blown from the target vane 113.

Figure 22:
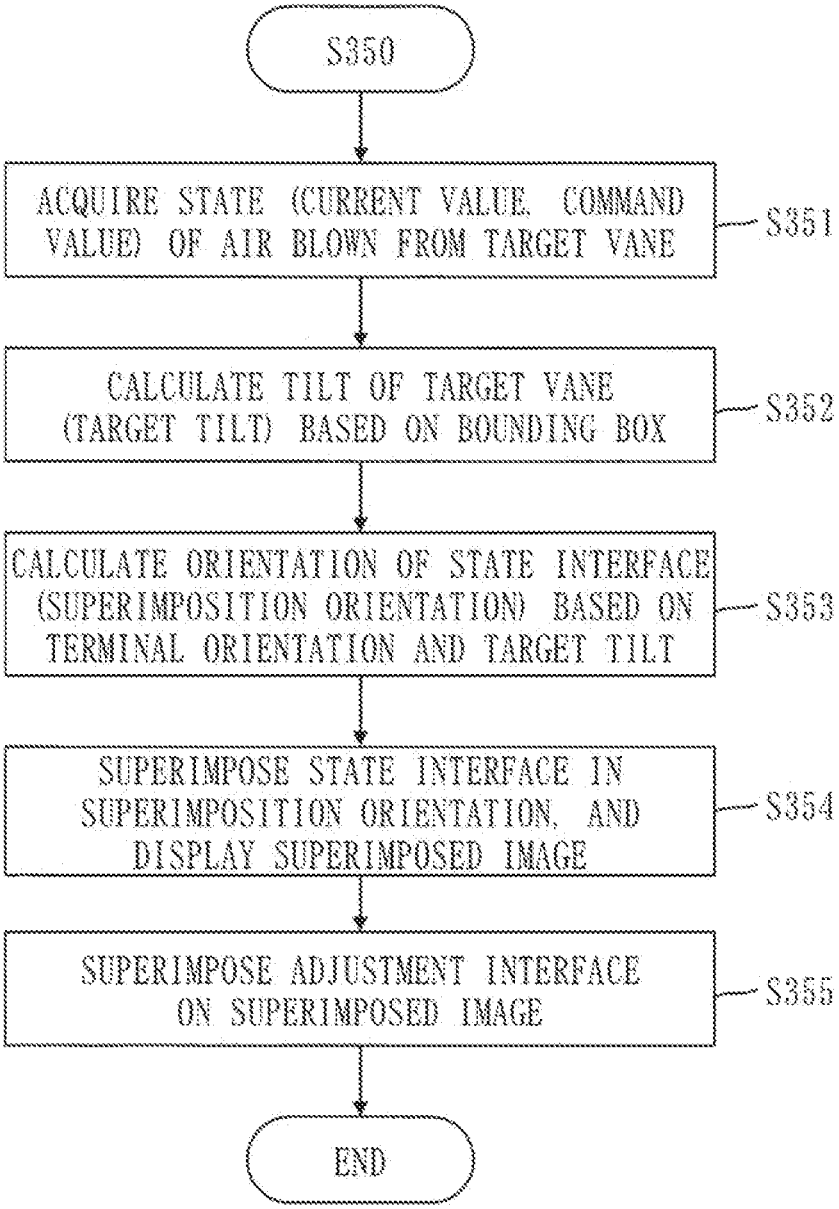
FIG. 22 is a flowchart of step S350 in Embodiment 3.

Based on FIG. 22, a procedure for step S350 will be described.

In step S351, the image display unit 215 acquires data that indicates a state of the air blown from the target vane 113 (target state).

The target state is represented by a current value and a command value.

The current value is data that indicates the current state of the air blown from the target vane 113.

The command value is data that indicates the state of the air blown from the target vane 113 after adjustment.

Specifically, the image display unit 215 acquires the current value by communicating with the air-conditioning indoor unit 110 (or the air-conditioning controller 120).

The image display unit 215 acquires a command initial value from the storage unit 290.

The command initial value is an initial command value. For example, the command value of the preceding time or the current value is used as the command initial value.

In step S352, the image display unit 215 calculates a target tilt based on the bounding box of the target vane 113.

The target tilt is a tilt of the target vane 113 in the captured image 281.

For example, the image display unit 215 calculates the target tilt, using an existing technique such as the Hough transform.

In step S353, the image display unit 215 calculates a superimposition orientation based on the terminal orientation and the target tilt.

The superimposition orientation is an orientation of the state interface 287 that is superimposed on the captured image 281. For example, the superimposition orientation is represented by a rotation matrix in a reference coordinate system of the state interface 287.

In step S354, the image display unit 215 superimposes the state interface 287 in the superimposition orientation at the position of the target vane 113 on the captured image 281 so as to generate a superimposed image 282, and displays the superimposed image 282 on the display 206.

Specifically, the image display unit 215 operates as described below.

First, the image display unit 215 generates the state interface 287 that indicates the state of the air blown from the target vane 113 based on the target state (the current value and the command value).

Next, the image display unit 215 rotates the state interface 287 in accordance with the superimposition orientation.

Next, the image display unit 215 superimposes the rotated state interface 287 at the position of the target vane 113 on the captured image 281 so as to generate the superimposed image 282.

Then, the image display unit 215 displays the superimposed image 282 on the display 206.

In step S355, the image display unit 215 superimposes the adjustment interface 284 on the displayed superimposed image 282.

Figure 23:
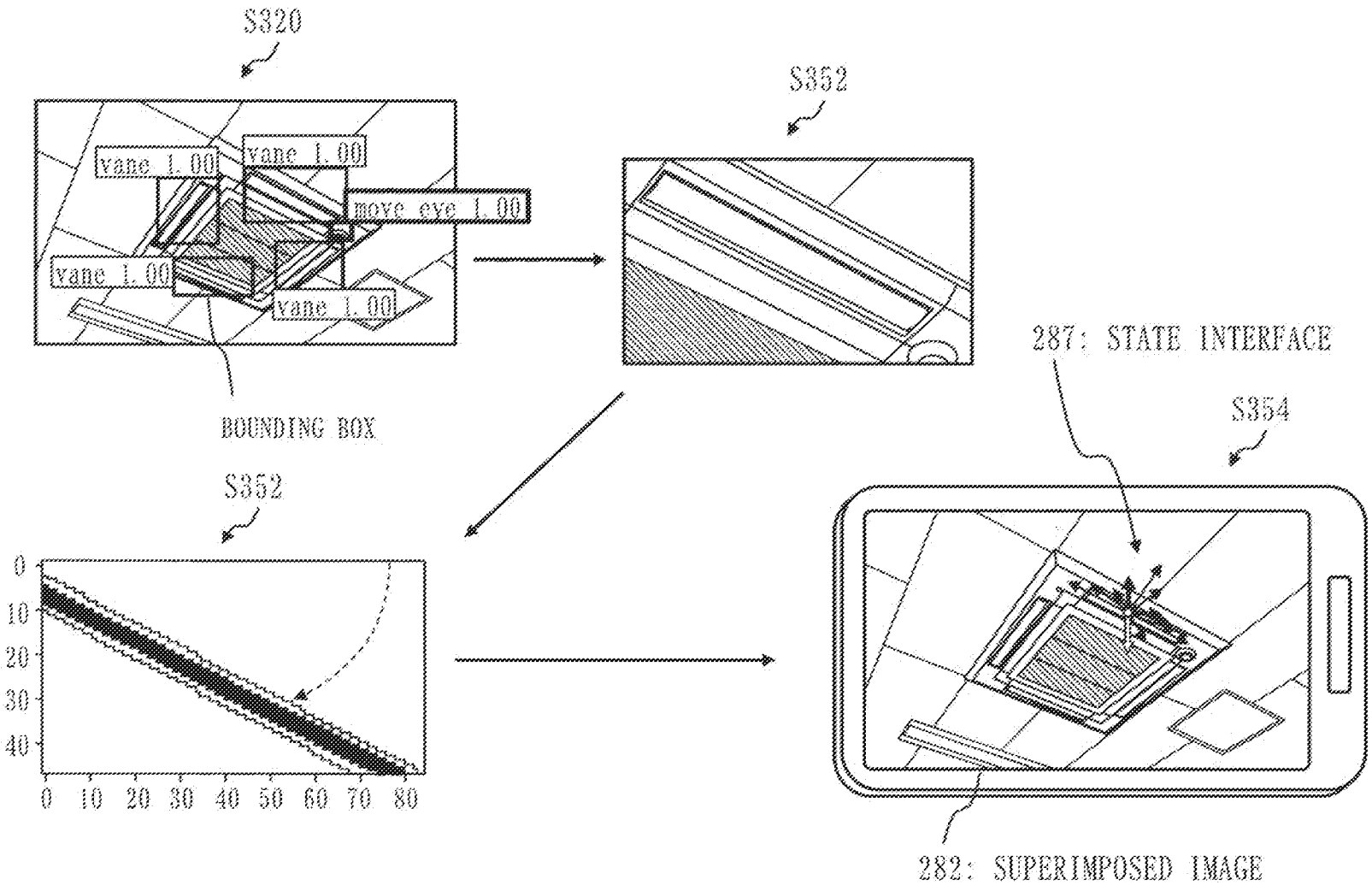
FIG. 23 is a figure illustrating a procedure for displaying a state interface 287 in Embodiment 3.

FIG. 23 illustrates an overview of a procedure for displaying the state interface 287.

First, the bounding boxes of the plurality of vanes 111 are estimated (step S320).

Next, the bounding box of the target vane 113 is selected, and the tilt of the target vane 113 is calculated based on the bounding box of the target vane 113 (step S352).

Then, the state interface 287 is superimposed at the position of the target vane 113 in accordance with the tilt of the target vane 113, and the superimposed image 282 is displayed (step S354).

Referring back to FIG. 20, the description will be continued from step S360.

In step S360, the user operates the adjustment interface 284 to designate adjustment details for the target vane 113.

Then, the designation acceptance unit 216 accepts the adjustment details for the target vane 113.

Step S360 corresponds to step S160 in Embodiment 1.

Figure 24:
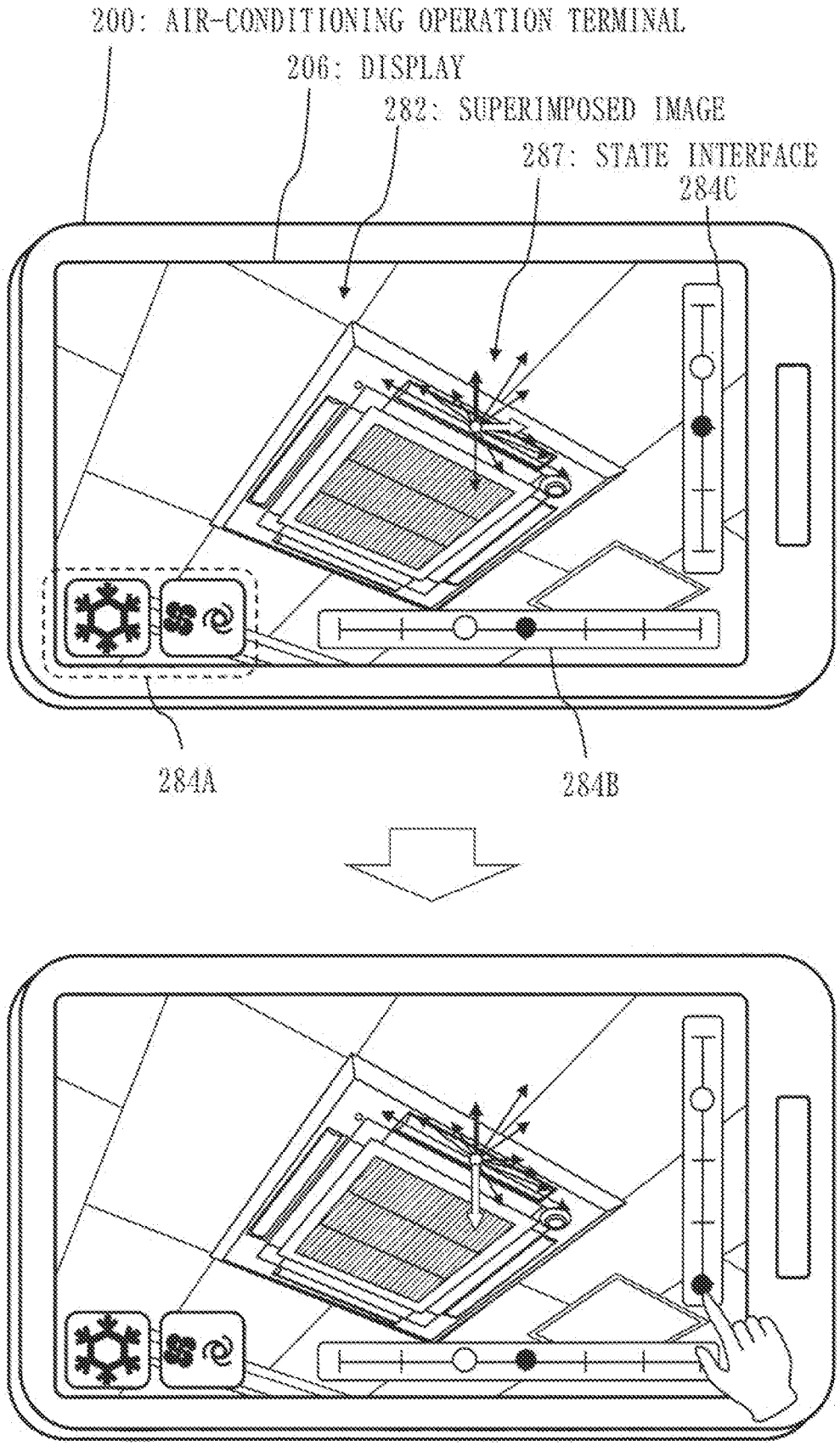
FIG. 24 is a figure illustrating a superimposed image 282 in Embodiment 3.

FIG. 24 illustrates a specific example of the superimposed image 282.

In the superimposed image 282, the state interface 287 and a plurality of adjustment interfaces (284A to 284C) are superimposed.

The state interface 287 indicates directions and force of the air blown from the target vane 113 with arrows.

The adjustment interface 284A is icons.

The adjustment interfaces (284B and 284C) are sliders. The user operates them by moving filled-circle parts. By operating the adjustment interface 284B, the air direction can be designated horizontally. By operating the adjustment interface 284C, the air direction can be designated in the upward/downward direction.

The image display unit 215 may indicate a mark representing the current value and a mark representing the command value on at least one of the state interface 287 and the adjustment interfaces (284B and 284C).

Referring back to FIG. 20, step S370 will be described.

In step S370, the air-conditioning setting unit 217 sets the adjustment details for the target vane 113 in the air-conditioning indoor unit 110.

Step S370 is the same as step S170 in Embodiment 1.

Description of Implementation Example

Embodiment 3 may be applied to Embodiment 2. That is, the target vane 113 may be selected from the candidate vane group 114.

Effects of Embodiment 3

In Embodiment 3, the state interface 287 is displayed. This makes it possible to perform operations for adjusting the air direction, air volume, and so on of the target vane 113 more intuitively for the air-conditioning apparatus 101 whose indoor unit has the plurality of vanes 111.

Embodiment 4

Figure 25:
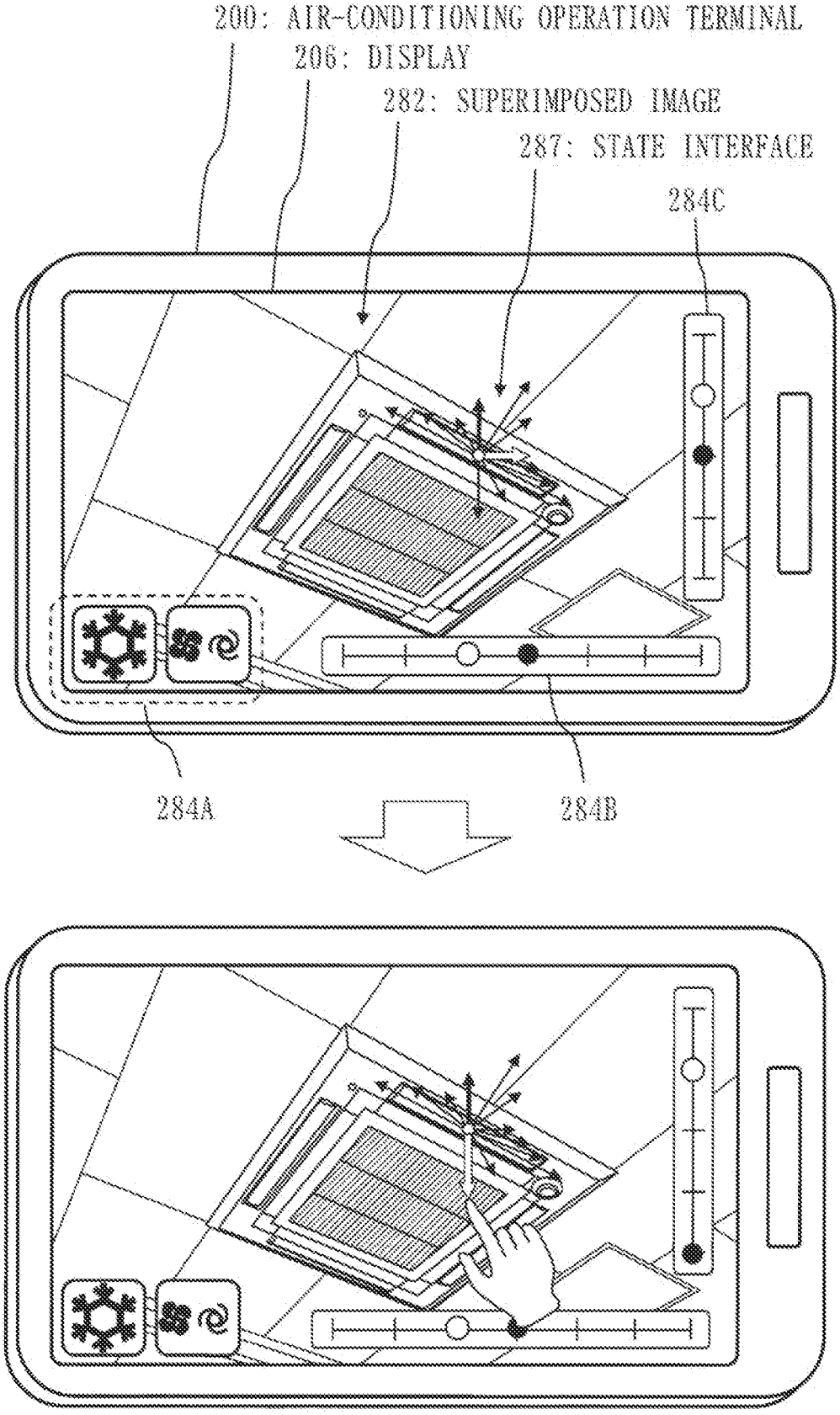
FIG. 25 is a figure illustrating a superimposed image 282 in Embodiment 4.

With regard to an embodiment in which the state interface 287 also functions as the adjustment interface 284, differences from Embodiment 3 will be mainly described based on FIG. 25.

*Description of Configuration*

The configuration of the air-conditioning system 100 is the same as the configuration in Embodiment 3.

*Description of Operation*

The procedure for the air-conditioning operation method is the same as the procedure in Embodiment 3.

However, step S360 differs from processing of Embodiment 3 as described below.

The state interface 287 also functions as the adjustment interface 284. That is, the state interface 287 is a GUI that indicates the state of the air blown from the target vane 113, and is also a GUI for designating adjustment details for the air blown from the target vane 113.

In step S360, the user operates the state interface 287 to designate adjustment details for the target vane 113.

Then, the designation acceptance unit 216 accepts the adjustment details for the target vane 113.

FIG. 25 illustrates a specific example of the superimposed image 282.

The user operates the state interface 287 by expanding or contracting the arrow that indicates the air direction that the user wishes to adjust. By operating the state interface 287, the air volume in each air direction can be designated.

Effects of Embodiment 4

In Embodiment 4, the state interface 287 is operated directly.

This makes it possible to perform operations for adjusting the air direction, air volume, and so on of the target vane 113 more intuitively for the air-conditioning apparatus 101 whose indoor unit has the plurality of vanes 111.

Supplement to Embodiments

Figure 26:
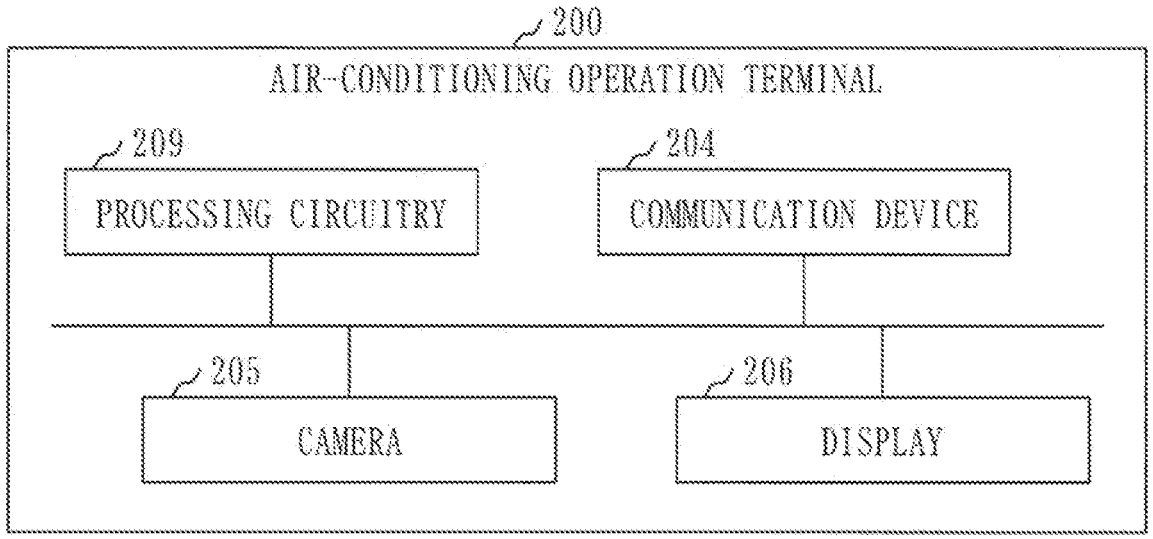
FIG. 26 is a hardware configuration diagram of the air-conditioning operation terminal 200 in the embodiments.

Based on FIG. 26, a hardware configuration of the air-conditioning operation terminal 200 will be described.

The air-conditioning operation terminal 200 includes processing circuitry 209.

The processing circuitry 209 is hardware that realizes the image acquisition unit 211, the object detection unit 212, the vane identification unit 213, the vane selection unit 214, the image display unit 215, the designation acceptance unit 216, the air-conditioning setting unit 217, and the orientation acquisition unit 218.

The processing circuitry 209 may be dedicated hardware, or may be the processor 201 that executes programs stored in the memory 202.

When the processing circuitry 209 is dedicated hardware, the processing circuitry 209 is, for example, a single circuit, a composite circuit, a programmed processor, a parallel-programmed processor, an ASIC, an FPGA, or a combination of these.

The air-conditioning operation terminal 200 may include a plurality of processing circuitry as an alternative to the processing circuitry 209.

In the processing circuitry 209, some functions may be realized by dedicated hardware and the remaining functions may be realized by software or firmware.

As described above, the functions of the air-conditioning operation terminal 200 can be realized by hardware, software, firmware, or a combination of these.

Each of the embodiments is an example of a preferred embodiment, and is not intended to limit the technical scope of the present disclosure. Each of the embodiments may be partially implemented or may be implemented in combination with another embodiment. The procedures described using flowcharts or the like may be suitably changed.

Each "unit" that is an element of the air-conditioning operation terminal 200 may be interpreted as "process", "step", "circuit", or "circuitry".

REFERENCE SIGNS LIST

100: air-conditioning system, 101: air-conditioning apparatus, 102: air-conditioning outdoor unit, 110: air-conditioning indoor unit, 111: vane, 112: extension part, 113: target vane, 114: candidate vane group, 119: communication device, 120: air-conditioning controller, 121: processing circuitry, 122: communication device, 123: display, 124: air-conditioning control unit, 200: air-conditioning operation terminal, 201: processor, 202: memory, 203: auxiliary storage device, 204: communication device, 205: camera, 206: display, 207: orientation sensor, 209: processing circuitry, 211: image acquisition unit, 212: object detection unit, 213: vane identification unit, 214: vane selection unit, 215: image display unit, 216: designation acceptance unit, 217: air-conditioning setting unit, 218: orientation acquisition unit, 281: captured image, 282: superimposed image, 283: target identification mark, 284: adjustment interface, 285: superimposed image, 286: candidate identification mark, 287: state interface, 290: storage unit, 291: learned model, 292: vane identification data.

The invention claimed is:

1. An air-conditioning operation terminal comprising processing circuitry to:

acquire a captured image obtained by capturing an image of an air-conditioning indoor unit including a plurality of vanes;

detect the plurality of vanes in the captured image, using a learned model generated by machine learning on training images in each of which an air-conditioning indoor unit of a same type as the air-conditioning indoor unit is captured;

select a target vane from the plurality of vanes in the captured image, the target vane being one vane for which air to be blown is adjusted;

display, as a superimposed image, the captured image on which a target identification mark for identifying the target vane and an adjustment interface are superimposed, the adjustment interface being a graphical user interface for designating adjustment details for the air to be blown from the target vane;

accept adjustment details designated by operating the adjustment interface; and set the accepted adjustment details in the air-conditioning indoor unit.

2. The air-conditioning operation terminal according to claim 1, wherein the air-conditioning indoor unit includes an extension part, and wherein the processing circuitry detects the plurality of vanes and the extension part in the captured image, and determines a positional relationship of each of the plurality of vanes with respect to the extension part in the captured image, and identifies each of the plurality of vanes based on the determined positional relationship.

3. The air-conditioning operation terminal according to claim 2, wherein the processing circuitry identifies an identifier of each of the plurality of vanes, using vane identification data that indicates the positional relationship of each of the plurality of vanes with respect to the extension part and the identifier of each of the plurality of vanes.

4. The air-conditioning operation terminal according to claim 1, wherein the processing circuitry estimates a bounding box of each of the plurality of vanes, using the learned model, and determines a position of each of the plurality of vanes based on the bounding box of each of the plurality of vanes.

5. The air-conditioning operation terminal according to claim 1, wherein the processing circuitry selects, as a candidate vane group, two or more vanes from the plurality of vanes in the captured image, displays the captured image on which two or more candidate identification marks corresponding to the two or more vanes constituting the candidate vane group are superimposed, accepts an identifier of the one vane that is designated by selecting one candidate identification mark of the two or more candidate identification marks, and selects, as the target vane, the one vane identified by the accepted identifier from the candidate vane group.

6. The air-conditioning operation terminal according to claim 1, wherein the processing circuitry acquires a terminal orientation that indicates an orientation of the air-conditioning operation terminal, uses the learned model to estimate a bounding box of each of the plurality of vanes in the captured image, and calculates, as a target tilt, a tilt of the target vane in the captured image based on the bounding box of the target vane, calculates a superimposition orientation based on the terminal orientation and the target tilt, and generates the superimposed image by superimposing a state interface in the superimposition orientation at a position of the target vane on the captured image, the state interface being a graphical user interface that indicates a state of air blown from the target vane.

7. The air-conditioning operation terminal according to claim 6, wherein the state interface is used as the adjustment interface, and wherein the processing circuitry accepts the adjustment details designated by operating the state interface.

8. A non-transitory computer readable medium storing an air-conditioning operation program to cause a computer to execute:

an image acquisition process of acquiring a captured image obtained by capturing an image of an air-conditioning indoor unit including a plurality of vanes;

an object detection process of detecting the plurality of vanes in the captured image, using a learned model generated by machine learning on training images in each of which an air-conditioning indoor unit of a same type as the air-conditioning indoor unit is captured;

a vane selection process of selecting a target vane from the plurality of vanes in the captured image, the target vane being one vane for which air to be blown is adjusted;

an image display process of displaying, as a superimposed image, the captured image on which a target identification mark for identifying the target vane and an adjustment interface are superimposed, the adjustment interface being a graphical user interface for designating adjustment details for the air to be blown from the target vane;

a designation acceptance process of accepting adjustment details designated by operating the adjustment interface; and an air-conditioning setting process of setting the accepted adjustment details in the air-conditioning indoor unit.

9. An air-conditioning system comprising:

an air-conditioning indoor unit including a plurality vanes; and an air-conditioning operation terminal, wherein the air-conditioning operation terminal includes processing circuitry to:

acquire a captured image obtained by capturing an image of the air-conditioning indoor unit;

detect the plurality of vanes in the captured image, using a learned model generated by machine learning on training images in each of which an air-conditioning indoor unit of a same type as the air-conditioning indoor unit is captured;

select a target vane from the plurality of vanes in the captured image, the target vane being one vane for which air to be blown is adjusted;

display, as a superimposed image, the captured image on which a target identification mark for identifying the target vane and an adjustment interface are superimposed, the adjustment interface being a graphical user interface for designating adjustment details for the air to be blown from the target vane;

accept adjustment details designated by operating the adjustment interface; and set the accepted adjustment details in the air-conditioning indoor unit.

10. An air-conditioning operation terminal comprising:

processing circuitry to:

acquire a captured image obtained by capturing an image of an air-conditioning indoor unit including a plurality of vanes and an extension part;

detect the plurality of vanes in the captured image and detect a position number of each of the plurality of vanes in the capture image, using a learned model generated by machine learning on training images in each of which an air-conditioning indoor unit of a same type as the air-conditioning indoor unit is captured;

identify each of the plurality of vanes based on a positional relationship of each of the plurality of vanes with respect to the extension part in the captured image, using vane identification data that is generated based on a vane that is actually activated when the air-conditioning indoor unit is operated according to the position number of each of the plurality of vanes, and indicates a positional relationship of each of the plurality of vanes with respect to the extension part and an identifier of each of the plurality of vanes;

accept adjustment details designated by operating the adjustment interface for designating adjustment details for the air to be blown from each of the plurality of vanes; and transmit the accepted adjustment details with the identifier of a target vane to the air-conditioning indoor unit to set the accepted adjustment details in the air-conditioning indoor unit.

* * * * *